United States Patent [19]

Sakanoue et al.

[11] Patent Number: 4,500,634

[45] Date of Patent: Feb. 19, 1985

[54] SILVER HALIDE COLOR PHOTOGRAPHIC MATERIAL

[75] Inventors: Kei Sakanoue; Morio Yagihara; Seigi Ichijima; Kimitoshi Nagao, all of Kanagawa, Japan

[73] Assignee: Fuji Photo Film Co., Ltd., Kanagawa, Japan

[21] Appl. No.: 526,171

[22] Filed: Aug. 24, 1983

[30] Foreign Application Priority Data

Aug. 24, 1982 [JP] Japan ..... 57-146712

[51] Int. Cl.[3] ..... G03C 7/26

[52] U.S. Cl. ..... 430/544; 430/548; 430/553; 430/555; 430/557; 430/558; 430/957

[58] Field of Search ..... 430/544, 548, 382, 381, 430/957, 553, 555, 557, 558

[56] References Cited

U.S. PATENT DOCUMENTS

| | | | |
|---|---|---|---|
| 3,227,554 | 1/1966 | Barr et al. | 430/382 |
| 4,367,282 | 1/1983 | Yagihara et al. | 430/387 |
| 4,388,404 | 6/1983 | Morigaki et al. | 430/372 |
| 4,409,320 | 10/1983 | Yagihara et al. | 430/548 |

*Primary Examiner*—J. Travis Brown

*Attorney, Agent, or Firm*—Sughrue, Mion, Zinn, Macpeak and Seas

[57] ABSTRACT

A silver halide color photographic material in which both a coupler capable of releasing a diffusible development restrainer by coupling and a polymer coupler latex are present to increase visual sharpness.

9 Claims, 3 Drawing Figures

SILVER HALIDE COLOR PHOTOGRAPHIC MATERIAL

FIELD OF THE INVENTION

The present invention relates to a silver halide color photographic material and, more particularly, to a silver halide color photographic material for picture taking use which has improved visual sharpness.

BACKGROUND OF THE INVENTION

In recent years, 110 size cameras have come into wide use and it has been desired that prints obtained by enlarging pictures taken on such small sized picture planes have a quality nearly equal to those attained by enlarging large sized picture planes. Therefore, it has been necessary to develop color photographic materials having excellent granularity and sharpness even when enlarged to high magnification.

In general, visual sharpness is deteriorated with an increase in enlargement magnification. Sharpness may be evaluated based on the MTF (Modulation Transfer Function) curve in the case of high enlargement magnification (see T. H. James, et al., *The Theory of the Photographic Process,* 3rd ed., p. 536, Macmillan, New York (1966)). For instance, in the case that a picture plane is enlarged in size with a magnification 1.7 times as high as in the case to be a reference standard. If an MTF value equal to that at the spatial frequency increased by a factor of 1.7 is obtained in such a case, the resulting print would be theoretically expected, as illustrated in FIG. 1 to have a sharpness equivalent to that obtained from a negative image plane whose size is 1.7 times the size employed in the above-described case, provided that its sharpness is compared with that of the reference standard using prints having the same size. Thus, if a sharpness in a high spatial frequency region is heightened, deterioration of visual sharpness due to enlargement can be prevented from occurring even in the case of high magnifications.

In order to heighten the sharpness in the high spatial frequency region, it is necessary to raise the MTF values in the high spatial frequency region. The heightening of the sharpness in the high spatial frequency region can be attained by suppressing the occurrence of the light-scattering phenomenon as much as possible. For this purpose, it is essential to reduce the thickness of emulsion layers each (to about ½), that is, to render the photographic film thin.

As for measures for thinning a photographic film, there are reducing the amounts of the silver halides coated, reducing the content of gelatin used as a binder, reducing the amounts of couplers coated, reducing the amounts of high boiling point solvents used for dispersion of the couplers, and so on.

Among these measures, reduction of the coated silver amount can have the greatest effect upon suppression of light-scattering, but it causes a deterioration of granularity. On the other hand, a reduction of the gelatin content causes changes in the pressure characteristics of the emulsions and a reduction of coated coupler amounts causes a decrease in color densities and other undesirable side effects. Accordingly, it is important to reduce the amounts of organic solvents to use of dispersing couplers.

However, in the conventionally used method of dispersing color couplers in high boiling point solvents, it is difficult to reduce the amounts of the solvents beyond a certain limit from the viewpoints of solubility, coated film stability, and so on.

Accordingly, various investigations have been undertaken, and it has now been found that if so-called polymer couplers are employed, the amounts of high boiling point solvent(s) can be reduced to a great extent without the above-described side effects. As for the polymer couplers, a brief description is given in T. H. James, et al., *The Theory of the Photographic Process,* 4th ed., p. 347. Also, as for the MTF, there are descriptions in R. L. Lamberts, *Application of Sine-Wave Techniques to Image-Forming Systems,* J. SMPTE, 71 (9), 1962, J. C. Dainty et al., *Image Science,* Academic Press (1974), Chap. 7, and T. H. James et al., *The Theory of the Photographic Process,* 4th ed., Chap. 21. As the the spatial frequency, there is a description in the above *The Theory of the Photographic Process,* Chap. 21.

However, such an improvement in sharpness by reducing the thickness of the coated emulsion layers to heighten sharpness in the high spatial frequency region alone is insufficient since camera miniaturization has been rapid and enlargement magnification requirements for images is being raised.

Accordingly, methods for further improving sharpness in the high spatial frequency region without adverse effects have been investigated.

SUMMARY OF THE INVENTION

A primary object of the present invention is to provide a method for improving sharpness in a high spatial frequency region without adverse effects.

Another object of the present invention is to provide a color light-sensitive material which does not undergo a decrease in sharpness even when an image formed therein is enlarged to high magnification.

The above-described objects are attained by enhancing sharpness not only in a high spatial frequency region but also a low spatila frequency region, specifically, by reducing light-scattering at the time of exposure and increasing an edge effect.

DETAILED DESCRIPTION OF THE INVENTION

As for the edge effect, a brief description is given in the above stated *The Theory of the Photographic Process,* Chap. 21.

As a result of examining the relationship between visual sharpness and MTF values, it has been found that not only do MTF values in the high spatial frequency region but also those in the low spatial frequency region have, in general, substantial effects upon the visual sharpness.

Figure 1:
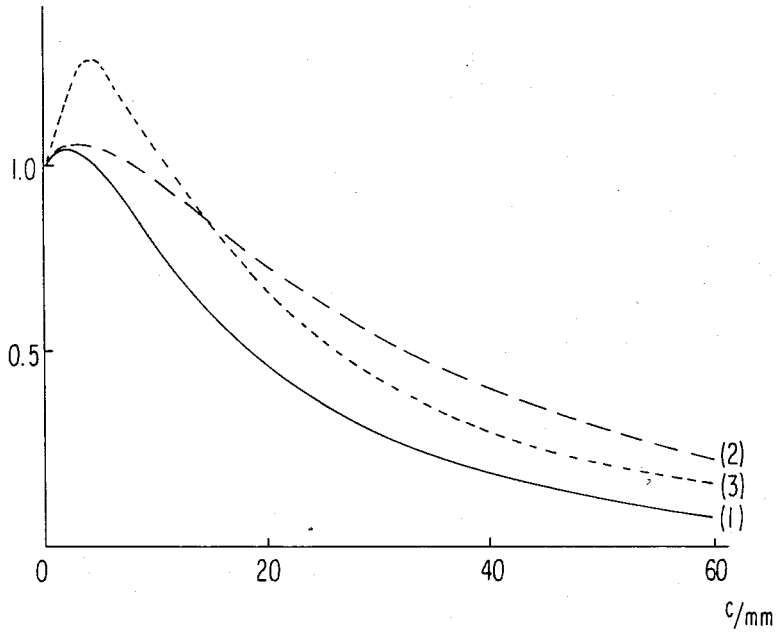
FIG. 1 represents MTF curves used for making simulation images, with the MTF value as the ordinate and spatial frequency as the abscissa.

That is, as a result of investigating MTF curves which substantially equivalently correspond to sharpness from the visual point of view to MTF curves which will be obtained when the curve (2) of FIG. 1 is realized, we found, by drawing up simulation images corresponding to various MTF curves, that if an MTF curve is raised to a great extent at low spatial frequencies near 5 cycles/mm as shown in FIG. 1, one obtains a sharpness visually equivalent to that which has MTF curve (2) even if on the high spatial frequency area above 20 cycles/mm the MTF curve is not so well improved as to be seen in the MTF curve (2).

That is, light-sensitive materials having MTF curves (2) and (3), respectively, provide almost equal visual sharpness when they are enlarged with the same print magnification. Thus, raising the MTF values in the high spatial frequency region through reducing light scattering and also raising MTF values at low spatial frequencies near 5 cycles/mm makes it possible to improve visual sharpness in the high spatial frequency region. Such an effect is especially great when MTF values at frequencies near 5 cycles/mm are raised to over 1.15.

The Thurstone method is well suited for the evaluation of visual sharpness and is described in, e.g., Thurstone, L. L., *A Law of Comparative Judgment,* Psychol. Rev., 34, pp. 273–286 (1927), Guilford, J. P., *Psychometric Methods,* McGraw-Hill (1954), and *Sensory Test Handbook,* Nikka Giren Publisher (1973). The Thurstone values herein are calculated using $S_D(k)$ defined by (2, 24) in the above text. These values are expressed in terms of $\sigma\sqrt{2}$, which means that if such values differ by one unit, 67% of persons viewing the same recognize a difference in resolution therebetween.

The above descriptions are concluded by evaluating the sharpness of simulation images which are drawn up using a film having a certain MTF curve by the Thurstone method. The method of drawing up simulation images is explained below.

An original picture to be used as the source of simulation is prepared as a color negative by photographing with a camera of the 4×5 inch size. This original picture is separated into 2,048×2,048 dots of a square imaging element having an area of 50×50 μm and blue (B), green (G) and red (R) negative densities at the individual dots are picked out in the form of their respective digital image signals. The spatial frequency spectrum obtained by subjecting these digital image signals to Fourier transformation (using FFT) is subjected to an imaging treatment using a spatial frequency filtering technique. Thereafter, the characteristics of the spatial frequency filter used are let to correspond to the chemical MTF (abbreviated as C-MTF hereinafter) which depends on both a depressing degree of the edge effect and diffusibility.

The characteristics of the spatial frequency filter are determined using the MTF values of the camera, the film printer (including print magnification) and the paper used.

Next, an inverse Fourier transformation is carried out, whereby, B, G and R digital image signals which are changed in sharpness corresponding to the edge effect are obtained. From these signals there is made a color image of 100×100 mm in size (where a color paper is used) using a color scanner.

If various MTF curves are prepared using, for example, DIR compounds which differ in restraining degree (degree of development-restraining ability) and diffusibility, as described hereinafter, simulation images corresponding to the individual MTF curves can be drawn up in accordance with the above-described process and the thus drawn images can be psychologically evaluated by the Thurstone method and the relationship between the MTF curve and visual resolution can be derived. As for the Fourier transformation, there are descriptions in J. N. Goodman, *Introduction to Fourier Optics,* McGraw-Hill, New York (1965), J. C. Dainty, et al., *Image Science,* Academic Press Inc. (1974), Chap. 6 and A. Rosenfeld et al., *Digital Picture Processing, Academic Press Inc.* (1976), Chap. 7. As for the simulation images and the spatial frequency filtering technique, there is a description in the above described *Digital Picture Processing,* Chap. 7.

The way of evaluating images is described in further detail below.

The image sharpness of a print made in a system based on the combination of a color negative film and a color paper can be represented by the MTF value defined by the following equation (1):

$$M_{Np}(u)=M_{ca}(u)\times M_f(u)\times M_{pr}(u)\times M_p(u) \quad (1)$$

where $M_{ca}(u)$ represents the MTF value of the optical system of the camera, $M_f(u)$ represents the MTF value of the color negative film, $M_{pr}(u)$ represents the MTF value of the optical system of the color printer, and $M_p(u)$ represents the MTF value of the color paper.

The MTF value of a film consists of an optical MTF value, $M_o(u)$, and a chemical MTF value, $M_c(u)$, and is defined by the following equation (2):

$$M_f(u)=M_o(u)\times M_c(u) \quad (2)$$

$M_c(u)$ varies depending on the restraining degree and the diffusibility of the DIR coupler employed. If the MTF value in the case where the diffusibility is changed to $M_c'(u)$, then, $$M_f'=M_o(u)\times M_c'(u) \quad (3)$$

The spatial frequency filter employed when a print is made by simulation using a film which has the MTF value represented by equation (2) is defined by the following equation (4):

$$F(u) = \frac{M_{Np}(u)}{M_s(u)} = \frac{M_{ca}(u) \times M_f(u) \times M_{pr}(u) \times M_p(u)}{M_s(u)} \quad (4)$$

wherein $M_s(u)$ is the synthetic MTF value of the simulation system.

If another DIR compound having different characteristics were to be employed, the resulting filter would be calculated from equations (3) and (4).

A filtering treatment using this filter is carried out to make the corresponding color print.

Taking the B, G and R digital signals of an original picture for simulation to be $D_B(x,y)$, $D_G(x,y)$ and $D_R(x,y)$, respectively, the spectra represented by the following equation through their Fourier transformations will result:

$$\widetilde{D}_B(u,v) = \iint_{-\infty}^{+\infty} D(x,y)\cdot\exp[-2\pi i(ux+vy)]d\times dy \quad (5)$$

wherein x and y each represents a spatial distance on the original picture, u and v each is a spatial frequency, and D represents the Fourier spectrum.

A filtering treatment is achieved by multiplying equation (5) by equation (4), that is:

$$D_B(u,v)=F(w).D(u,v) \quad (6)$$

wherein w is equal to $\sqrt{u^2+v^2}$.

Subjecting equation (6) to inverse Fourier transformation, the real image signal changed in sharpness results per equation (7).

$$D'_B(x,y) = \iint_{-\infty}^{+\infty} \widetilde{D'}(u,v) \cdot \exp[2\pi i(ux + vy)]dudv \quad (7)$$

By forwarding this signal into a color image input-output apparatus developed by the Fuji Photo Film Co. Ltd., the actual simulation image is obtained. This color image input-output apparatus is described in Hisatoyo Kato, Masamitsu Ishida & Taizo Akimoto, Proc. Tokyo Symposium on Photo and Electro Imaging (SPSE & SPIE), September 1977. However, the apparatus will be briefly described below.

The color image input-output apparatus comprises a rotating drum type readout-write scanner unit and a mini computer. In this apparatus, an original picture is firstly fixed on a drum and readout is started. Electric signals corresponding to B, G and R densities of the original picture from the readout scanner are converted to digital signals by means of an A/D converter and recorded on a magnetic tape (MT) using the mini computer (with signals at a level of 12 bit=4096).

After data recorded on the MT are stored in the memory of an appropriate computer, the following procedurea are carried out in the recited order:

1. Conversion of electric signals (B, G, R) to optical densities;
2. Image treatment to change the edge effect of the negative film, i.e.,
   Fourier transformation→Spatial frequency filtering→Inverse Fourier transformation;
3. Density conversion,
   Negative film density→Color paper density→Densities of negatives for three color separation print; and
4. Conversion to input signals to be sent into the write scanner for reproducing separation negative densities (an input signal-output film density transformation curve having been prepared in advance).

The thus obtained input signals are then recorded on the MT.

The MT is set in the mini computer of the image output unit, and exposure is carried out using the write scanner. Thus, separation negatives for the three colors (black-and-white films) are completed. A color paper is repeatedly exposed to three separate colored lights, B, G and R, through their corresponding negatives previously finished adjustment of register marks (drawn at the time of the image treatment) to result in formation of color image.

According to this simulation process, images (1), (2) and (3) corresponding to MTF curves (1), (2) and (3), respectively, shown in FIG. 1, and images (1'), (2') and (3') corresponding to MTF curves which images (1) to (3) have, respectively, when enlarged 1.7 times, are generated, and psychological evaluation tests of the resolution of these images are carried out by 22 subjects according to the Thurstone method. The results obtained were as follows.

| Image Number | Thurstone Value |
|---|---|
| (1) | 0.00 |
| (2) | −1.55 |
| (3) | −1.75 |
| (1') | 2.55 |
| (2') | 0.25 |
| (3') | 0.13 |

As can be seen from the results of the above table, light-sensitive materials having MTF curves (2) and (3) have equal effects from the viewpoint of psychological sharpness.

As stated above, the objects of the present invention can be attained by reducing light scattering at the time of exposure and increasing the edge effect.

For the purpose of increasing the edge effect, so-called DIR couplers and an unsharp mask may be employed.

However, using an unsharp mask brings about a decrease in sensitivity and deterioration of granularity. Therefore, it has limits from the standpoint of practical use.

As for the DIR couplers, there are known compounds as described in U.S. Pat. Nos. 3,227,554, 3,701,783, 3,615,506, 3,617,291, etc., and in Japanese Patent Publication No. 34933/80 and obtained by improving on the above-described compounds.

While the DIR couplers described in these patents can heighten the edge effect in the low spatial frequency region, simultaneously therewith they bring about a remarkable reduction in sensitivity and a lowering of maximum color density. That is, taking the case that the above-described couplers are used to raise the MTF value at 5 cycles/mm up to 1.20 or above, the coupler must be added in a great amount and, consequently, a lowering of maximum density and drop in sensitivity are caused. In order to compensate for such decreases in maximum density and sensitivity, it is necessary to increase the coating coverage, e.g., of silver. However, the increased coating coverage brings about a decrease of MTF values in the high spatial frequency region, that is, a decrease in sharpness. Therefore, visual sharpness cannot be increased on the whole.

On the other hand, it has been found that if DIR couplers having a splitting-off groups of high diffusibility are employed as the DIR compound, they exhibit higher edge effects than those having less diffusible splitting-off groups, so long as they are compared on the basis of the same restraining effect. Thus, one can heighten the edge effect and prevent undesirable side effects such as a drop in sensitivity and a lowering of maximum color density.

Accordingly, by using DIR couplers capable of releasing splitting-off groups having high diffusibility, one can raise MTF values in the low spatial frequency region without lowering MTF values in the high spatial frequency region.

In accordance with the present invention, silver halide color photographic materials having excellent granularity and sharpness even when enlarged to high magnification can be provided by containing both DIR couplers capable of releasing splitting-off groups having high diffusibility and polymer couplers in the silver halide color photographic materials.

Changes in MTF curves caused by using diffusible DIR couplers are theoretically explained below.

In the high spatial frequency region, MTF curves are controlled by light scattering, whereas in the low spatial frequency region they are controlled by the edge effect arising from development restraint. In the former region, MTF curves change depending on the thicknesses of layers present, e.g., silver halide emulsion layers, from which light is scattered. Thus, the thicker the layers, the greater the influence of light scattering becomes. Consequently, MTF curves are greatly lowered in the high spatial frequency region. On the other hand, in the latter region, if the development restrainer used has high diffusibility, the edge effect extends to a great distance. Consequently, MTF curves are raised even in this region.

Figure 2:
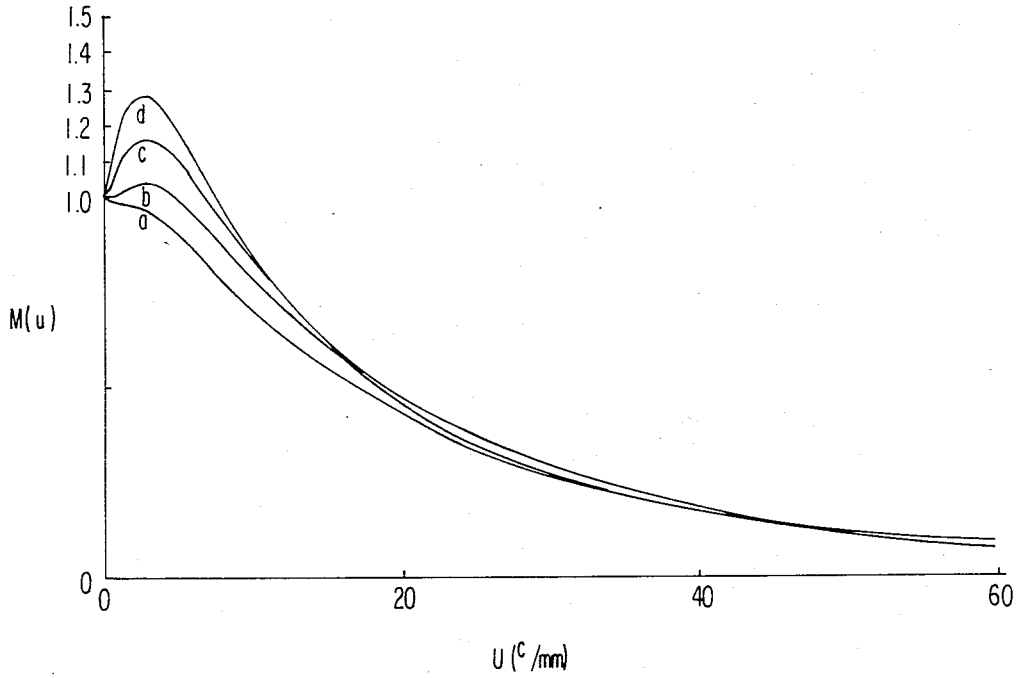
FIG. 2 represents MTF curves made by synthesizing C-MTF (chemical MTF) curves with O-MTF (optical MTF) curves shown in FIG. 3.
Figure 3:
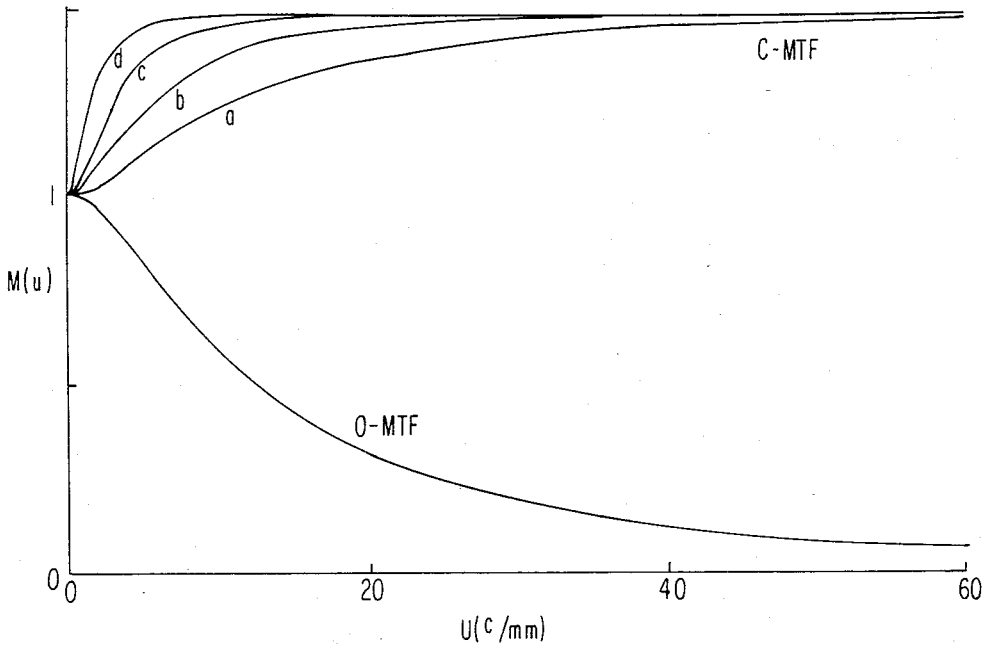
FIG. 3 represents MTF curves which depend on optical scattering (O-MTF) and MTF curves which depend on chemical factors, such as edge effect and so on (C-MTF).

The C-MTF curves of FIG. 3 are those obtained by heightening the diffusibility from a to d under the condition that the light scattering does not occur at all and the development restrainers used have the same restraining degree. As can be seen therefrom, the higher the diffusibility, the higher the MTF value in the low spatial frequency region. On the other hand, the O-MTF values represent the MTF curve under the condition that there is no edge effect, but a certain level of light scattering is observed. The actual MTF value is that which is obtained by multiplying the value on the C-MTF curve at each point, $M_c(u)$, by the value on the O-MTF curve at the corresponding point, $M_o(u)$. Therefore, the resultant MTF curves corresponding to the case that development restrainers which have the same restraining degree, but differ only in diffusibility, are employed are as shown in FIG. 2.

Thus, it is apparent that it is possible to raise MTF values as low spatial frequencies without raising the restraining degree of a development restrainer used. In order to raise MTF values at 2 to 5 cycles/mm up to 1.15 or above, it is desirable to employ a DIR compound having as a splitting-off group a development restrainer having a diffusibility of 0.4 or more. If MTF values in the above-described spatial frequency range are not less than 1.15, the psychological, visual sharpness is markedly improved.

For the purpose of examining the validity of the above-described theoretical explanation, the following experiment was carried out.

Samples 201 and 202 were prepared in the same manner as the Sample 101 in the Example illustrated hereinafter except in the sixth layer the couplers set forth in Table 1 were used in place of Coupler D used in the Sample 101. Each of Samples 101, 201 and 202 were exposed to white light through a pattern for MTF measurement and then subjected to the development processing described in the Example.

The MTF of the magenta image produced in each of the processed samples was measured. The results obtained are shown in Table 1.

TABLE 1

| Sample | DIR Coupler | Diffusibility of Development Reatrainer | MTF Spatial Frequency (cycles/mm) 5 | 20 | 35 | $D_{max}$ |
|---|---|---|---|---|---|---|
| 101 | D | 0.3 | 1.03 | 0.48 | 0.24 | 2.50 |
| 201 | D-2 | 0.74 | 1.18 | 0.51 | 0.24 | 2.45 |
| 202 | D-3 | 0.9 | 1.24 | 0.52 | 0.26 | 2.52 |

As can be seen from the results in Table 1, when the diffusibility of the splitting-off group is increased in spite of the same chemical structure with respect to the restraining moiety of the splitting-off group, the MTF value in the low spatial frequency region is markedly raised and that a drop in $D_{max}$ is not encountered. Thus, the validity of the simulation analysis using diffusible DIR couplers was verified by these results.

The magnitude of the diffusibility of a development restrainer can be measured in the following manner.

On a transparent support there were coated the layers described below in this order to prepare a multilayer color light-sensitive material (Sample B).

(1) A red-sensitive silver halide emulsion layer formed by coating at a coverage of 1.8 g silver per square meter (a thickness of 2 microns) a gelatin solution containing a silver iodobromide emulsion (containing 5 mol% of silver iodide, and having a mean grain size of 0.4 micron), to which red sensitivity had been imparted by using Sensitizing Dye I employed in the Example described hereinafter in an amount of $6\times10^{-5}$ mol per 1 mol silver, and 0.0015 mol/mol of silver of Coupler F.

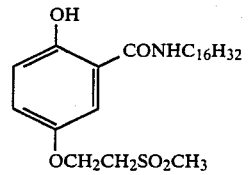

Coupler F (2) A gelatin layer containing the same silver iodobromide emulsion as used in the first layer (1) except that red sensitivity had not been imparted thereto, and polymethyl methacrylate particles (diameter of about 1.5μ) (having a coverage of 2 g silver per square meter and a thickness of 1.5μ).

In each of these layers, a conventional gelatin hardener and surface active agent were incorporated in addition to the above-described composition.

The other sensitive material (Sample A) was prepared in the same manner as Sample B except that the silver iodobromide emulsion which was incorporated in the second layer of Sample B was not present in the second layer of Sample A.

Sample A and Sample B each was subjected to wedgewise exposure and to development processing in the same manner as in the Example except that the development time was changed to 2 minutes and 10 seconds. On the other hand, different kinds of development restrainers were added to the same developing solution as used in the Example independently in such amounts that the image density of Sample A was reduced to one-half that obtained in the former experiment. Under the same conditions, Sample B was examined for magnitudes of reduction of image densities. Degrees of reduction of image densities in Sample B are used as a measure of the diffusibility of the development restrainer in the silver halide emulsion layer. The thus obtained results are set forth in Table 2.

TABLE 2

Diffusibility of Development Restrainer

| Development Restrainer | Addition Amount to Developing Solution | Reduction Rate of Image Density (%) Sample A | Sample B | Diffusibility (= B/A) |
|---|---|---|---|---|
| 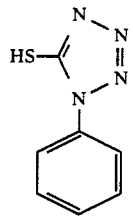 | $0.75 \times 10^{-4}$ M | 50 | 10 | 0.2 |
| 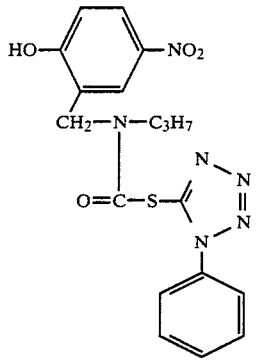 | $1 \times 10^{-4}$ | 50 | 25 | 0.5 |
| 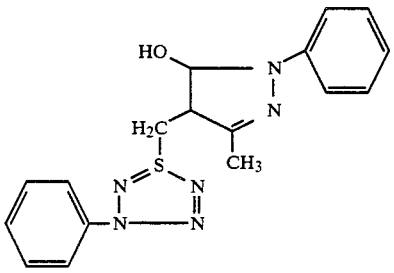 | $0.8 \times 10^{-4}$ | 48 | 20 | 0.42 |
| 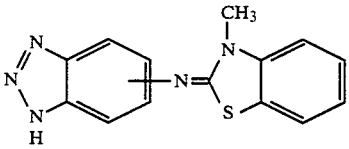 | $0.5 \times 10^{-4}$ | 50 | 15 | 0.3 |
| 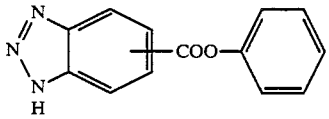 | $2 \times 10^{-4}$ | 52 | 37 | 0.74 |
| 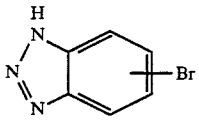 | $2.5 \times 10^{-4}$ | 51 | 45 | 0.9 |

Preferable DIR couplers capable of releasing highly diffusible development restrainers which can be employed in the present invention are those having diffusibilities of about 0.4 or more. They are represented by the following general formula (I):

$$A-(Y)_m \qquad \text{(I)}$$

wherein A represents a coupler component, m represents 1 or 2, and Y represents a group which is attached to the coupler component A at the coupling position thereof and can be eliminated from the coupler by reaction with the oxidation product of a color developing agent to produce a highly diffusible development restrainer or compound capable of releasing a development restrainer.

Any A will do so long as it functions as a coupler, and it is not always an essential property that A produce a dye by the coupling reaction.

In general formula (I), the moiety Y may be specifically illustrated by the following general formulae (II) to (IV):

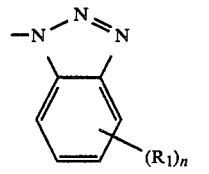
(IIa)

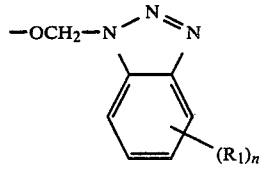
(IIb)

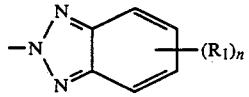
(III)

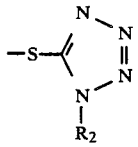
(IV)

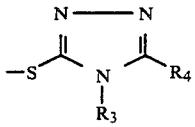
(V)

In general formulae (IIa), (IIb) and (III), $R_1$ represents an alkyl group, an alkoxy group, an acylamino group, a halogen atom, an alkoxycarbonyl group, a thiazolylideneamino group, an aryloxycarbonyl group, a acyloxy group, a carbamoyl group, an N-alkylcarbamoyl group, an N,N-dialkylcarbamoyl group, a nitro group, an amino group, an N-arylcarbamoyloxy group, a sulfamoyl group, an N-alkylcarbamoyloxy group, a hydroxy group, an alkoxycarbonylamino group, an alkylthio group, an arylthio group, an aryl group, a heterocyclic group, a cyano group, an alkylsulfonyl group or an aryloxycarbonylamino group. In general formulae (IIa), (IIb) and (III), n represents 1 or 2. When n is 2, two $R_1$'s may be the same or different, and the number of carbon atoms contained in n $R_1$'s is 0 to 10 in total. [When n $R_1$'s contain no carbon atoms (for example, $R_1$ is a nitro group), the number of carbon atoms is 0 in total.]

In general formula (IV), $R_2$ represents an alkyl group, an aryl group or a heterocyclic group.

In general formula (V), $R_3$ represents a hydrogen atom, an aryl group or a heterocyclic group; and $R_4$ represents a hydrogen atom, an alkyl group, an aryl group, a halogen atom, an acylamino group, an alkoxycarbonylamino group, an aryloxycarbonylamino group, an alkanesulfonamido group, a cyano group, a heterocyclic group, an alkylthio group or an amino group.

Examples of alkyl groups represented by $R_1$, $R_2$, $R_3$ or $R_4$ include both substituted and non-substituted ones. They may have a chain form or a cyclic form. Substituents such as alkyl groups may include a halogen atom, a nitro group, a cyano group, an aryl group, an alkoxy group, an aryloxy group, an alkoxycarbonyl group, an aryloxycarbonyl group, a sulfamoyl group, a carbamoyl group, a hydroxy group, an alkanesulfonyl group, an arylsulfonyl group, an alkylthio group, an arylthio group and so on.

Acyl groups represented by $R_1$, $R_2$, $R_3$ or $R_4$ may also have substituents. Suitable examples of such substituents include an alkyl group, an alkenyl group, an alkoxy group, an alkoxycarbonyl group, a halogen atom, a nitro group, an amino group, a sulfamoyl group, a hydroxy group, a carbamoyl group, an aryloxycarbonyl amino group, an alkoxycarbonylamino group, an acylamino group, a cyano group, a ureido group and so on.

If $R_1$, $R_2$, $R_3$ or $R_4$ represents a heterocyclic group, a hetero atom of such a group may be a nitrogen atom, an oxygen atom or a sulfur atom. A heterocyclic ring of such a group may be a 5-membered ring, 6-membered ring, or a condensed ring containing such a ring. Specific examples of such heterocyclic groups include a pyridyl group, a quinolyl group, a furyl group, a benzothiazolyl group, an oxazolyl group, an imidazolyl group, a thiazolyl group, a triazolyl group, a benzotriazolyl group, an imido group, an oxazinyl group and the like. These groups may be further substituted with substituents set forth as examples of those for the above-described aryl groups.

In general formula (IV), $R_2$ can contain 1 to 15 carbon atoms.

In general formula (V), the total number of carbon atoms which may be contained in $R_3$ and $R_4$ is 1 to 15.

Further, Y in general formula (I) may be represented by the following general formula (VI):

-TIME-INHIBIT (VI)

wherein the TIME moiety is attached to the coupler moiety at the coupling position thereof, can split off by reaction with a color developing agent, and after elimination from the coupler moiety, it can release the INHIBIT group with controlling the releasing time properly; and the INHIBIT moiety released becomes a development restrainer.

A -TIME-INHIBIT group in general formula (VI) can be specifically illustrated by the following general formulae (VII) to (XIII):

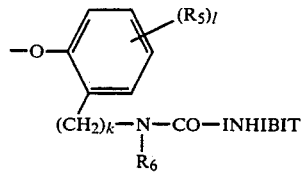
(VII)

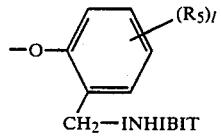
(VIII)

-continued (IX)

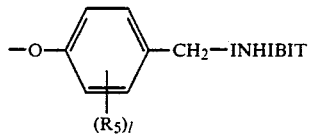

(X)

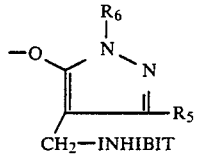

(XI)

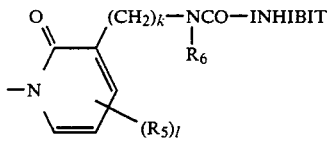

(XII)

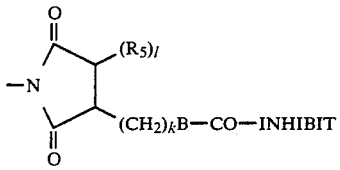

(XIII)

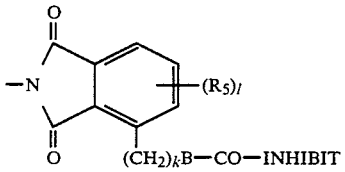

In the general formulae (VII) to (XIII), $R_5$ represents a hydrogen atom, a halogen atom, an alkyl group, an alkenyl group, an aralkyl group, an alkoxy group, an alkoxycarbonyl group, an anilino group, an acylamino group, a ureido group, a cyano group, a nitro group, a sulfonamido group, a sulfamoyl group, a carbamoyl group, an aryl group, a carboxy group, a sulfo group, a hydroxy group, or an alkanesulfonyl group; in general formulae (VII), (VIII), (IX), (XI) and (XIII), l represents 1 or 2; in general formlae (VII), (XI), (XII) and (XIII), k represents 0, 1 or 2; in general formulae (VII), (X) and (XI), $R_6$ represents an alkyl group, an alkenyl group, an aralkyl group, a cycloalkyl group or an aryl group; and in general formulae (XII) and (XIII), B represents an oxygen atom or

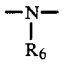

(wherein $R_6$ has the same meaning as defined above). The number of carbon atoms contained in l $R_5$'s per one molecule of general formula (VII), (VIII), (IX), (X), (XI), (XII) or (XIII) is 0 to 15 in total. The number of carbon atoms contained in $R_6$ is 1 to 15.

The INHIBIT moiety is represented by general formulae (IIa), (IIb), (III), (IV) and (V) except for changing the number of carbon atoms contained in individual general formulae as shown below.

As for the number of carbon atoms contained in the INHIBIT moiety, the number of carbon atoms contained in n $R_1$'s per one molecule of general formula (IIa), (IIb) or (III) is 1 to 32 in total; the number of carbon atoms contained in $R_2$ of general formula (IV) is 1 to 32; and the number of carbon atoms contained in $R_3$ and $R_4$ of general formula (V) is 1 to 32 in total.

When $R_5$ and $R_6$ represent alkyl groups, those alkyl groups may be substituted or unsubstituted, chain or cyclic. Substituents therefor include those which are set forth in the case that $R_1$ to $R_4$ represent an alkyl group.

When $R_5$ and $R_6$ represent aryl groups, those aryl groups may have substituents. Suitable examples of such substituents include those which are set forth in the case that $R_1$ to $R_4$ represent an aryl group.

Among the above-described diffusible DIR compounds, those having splitting-off groups represented by general formula (IIa), (IIb) or (V) are especially effective.

Suitable examples of the yellow color image forming coupler residue represented by A include those of pivaloyl acetanilide type, benzoyl acetanilide type, malonic diester type, malondiamide type, dibenzoylmethane type, benzothiazolyl acetamide type, malonic ester monoamide type, benzothiazolyl acetate type, benzoxazolyl acetamide type, benzoxazolyl acetate type, benzimidazolyl acetamide type and benzimidazolyl acetate type; the coupler residues derived from hetero ring-substituted acetamides or hetero ring-substituted acetates involved in U.S. Pat. No. 3,841,880; the coupler residues derived from the acyl acetamides described in U.S. Pat. No. 3,770,446, British Pat. No. 1,459,171, West German Patent Application (OLS) No. 2,503,099, Japanese Patent Application (OPI) No. 139738/75 (the term "OPI" as used herein refers to a "published unexamined Japanese patent application") and *Research Disclosure,* No. 15737; and the hetero ring type coupler residues described in U.S. Pat. No. 4,046,574.

Preferable examples of the magenta color image forming coupler residue represented by A include coupler residues having 5-oxo-2-pyrazoline nuclei, pyrazolo[1,5-a]benzimidazole nuclei or cyanoacetophenone type coupler residues.

Preferable examples of cyan color image forming coupler residue represented by A include the coupler residues having a phenol nucleus or an α-naphthol nucleus.

In addition, even if couplers cannot produce dyes substantially after they couple with an oxidation product of a developing agent and release development restrainers, they can exhibit their effects as DIR couplers to the same extent as the above-described color compound forming couplers. Examples of the above-described type of coupler residue represented by A include those which are described in U.S. Pat. Nos. 4,052,213, 4,088,491, 3,632,345, 3,958,999 and 3,961,959.

More specifically, A in the general formula (I) may represent a residue having the following general formula (IA), (IIA), (IIIA), (IVA), (VA), (VIA), (VIIA) or (VIIIA):

(IA)

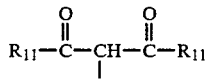

(IIA)

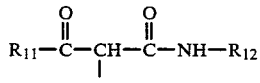

-continued

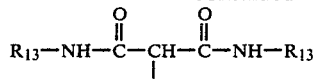

(IIIA)

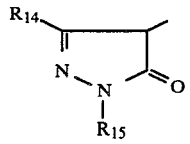

(IVA)

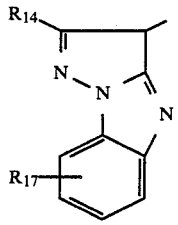

(VA)

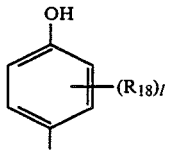

(VIA)

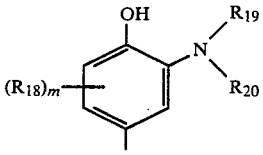

(VIIA)

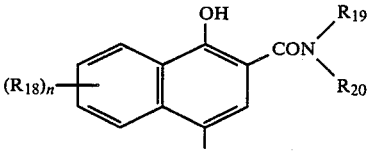

(VIIIA)

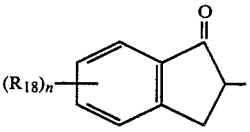

(IXA)

In the above-illustrated formulae, $R_{11}$ represents an aliphatic group, an aromatic group, an alkoxy group or a heterocyclic group; and $R_{12}$ and $R_{13}$ each represents an aromatic group or a heterocyclic group.

Aliphatic groups represented by $R_{11}$ are preferably those containing 1 to 22 carbon atoms, and may have substituents or not, and further, may have a chain form or a cyclic form. Preferable substituents therefor include an alkoxy group, an aryloxy group, an amino group, an acylamino group, a halogen atom and so on, which each may further have a substituent(s). Specific examples of aliphatic groups useful as $R_{11}$ include an isopropyl group, an isobutyl group, a tert-butyl group, an isoamyl group, a tert-amyl group, a 1,1-dimethylbutyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an α-aminoisopropyl group, and α-(diethylamino)isopropyl group, an α-(succinimido)isopropyl group, an α-(phthalimido)isopropyl group, an α-(benzenesulfonamido)isopropyl group and the like.

In the case that $R_{11}$, $R_{12}$ or $R_{13}$ represents an aromatic group (especially a phenyl group), it may have a substituent. Such an aryl group as phenyl or the like may be substituted with a 32 or less carbon atoms containing alkyl, alkenyl, alkoxy, alkoxycarbonyl, alkoxycarbonylamino, aliphatic amido, alkylsulfamoyl, alkylsulfonamido, alkylureido, alkyl-substituted succinimido or like group. The alkyl group therein may include one which contains an aromatic group such as phenylene in its main chain. Further, a phenyl group represented by $R_{11}$, $R_{12}$ or $R_{13}$ may be substituted with an aryloxy group, an aryloxycarbonyl group, an arylcarbamoyl group, an arylamido group, an arylsulfamoyl group, an arylsulfonamido group, an arylureido group or the like, the aryl moiety of which groups each may be substituted with one or more alkyl groups wherein the number of carbon atoms is 1 to 22 in total.

Furthermore, a phenyl group represented by $R_{11}$, $R_{12}$ or $R_{13}$ may be substituted with an amino group which includes one containing a lower ($C_1$ to $C_6$) alkyl group as a substituent, a hydroxy group, a carboxy group, a sulfo group, a nitro group, a cyano group, a thiocyano group or a halogen atom.

In addition, $R_{11}$, $R_{12}$ or $R_{13}$ may represent a substituent formed by condensing a phenyl group and another ring, such as naphthyl, quinolyl, isoquinolyl, chromanyl, coumaranyl, tetrahydronaphthyl or the like. These substituents may further have substituents in themselves.

In the case that $R_{11}$ represents an alkoxy group, the alkyl moiety thereof represents a $C_1$ to $C_{40}$, preferably $C_1$ to $C_{22}$, straight chain or branched chain alkyl, alkenyl, cycloalkyl or cycloalkenyl group, which each may be substituted with a halogen atom, an aryl group, an alkoxy group or so on.

In the case that $R_{11}$, $R_{12}$ or $R_{13}$ represents a heterocyclic group, the heterocyclic group is bonded to the carbon atom of the acyl moiety or the nitrogen atom of the amido moiety of an α-acylacetamido group through one of the carbon atoms forming the ring. As examples of such a heterocyclic ring, mention may be made of thiophene, furan, pyran, pyrrole, pyrazole, pyridine, pyrazine, pyrimidine, pyridazine, indolizine, imidazole, thiazole, oxazole, triazine, thiadiazine, oxazine and the like. These rings may further have substituents on the individual rings.

$R_{15}$ in the general formula (IVA) represents a $C_1$ to $C_{40}$, preferably $C_1$ to $C_{22}$, straight chain or branched chain alkyl (e.g., methyl, isopropyl, tert-butyl, hexyl, dodecyl, etc.), alkenyl (e.g., allyl, etc.), cyclic alkyl (e.g., cyclopentyl, cyclohexyl, norbornyl, etc.), aralkyl (e.g., benzyl, β-phenylethyl, etc.), cyclic alkenyl (e.g., cyclopentenyl, cyclohexenyl, etc.), or the like, which groups each may be substituted with a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic ring residue, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group, a mercapto group or so on.

$R_{15}$ in general formula (IVA) may further represent an aryl group (e.g., phenyl, α- or β-naphthyl, etc.). The aryl group may have one or more substituents. Specific examples of such a substituent include an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxy group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxy group, a mercapto group and so on. Among the above-described substituents, more preferable ones for $R_{15}$ are phenyl groups which are substituted by an alkyl group, an alkoxy group, a halogen atom or the like at at least one of the o-positions, because they can contribute to reduction of photocoloration or thermocoloration of couplers remaining in film layers.

Furthermore, $R_{15}$ may represent a heterocyclic ring residue (e.g., a 5- or 6-membered heterocyclic one containing as a hetero atom a nitrogen atom, an oxygen atom or a sulfur atom, or the condensed ring residues thereof, with specific examples including pyridyl, quinolyl, furyl, benzothiazolyl, oxazolyl, imidazolyl, naphthoxazolyl, etc.), a heterocyclic ring residue substituted with one of substituents set forth as examples for the above-described aryl group, an aliphatic or an aromatic acyl group, an alkylsulfonyl group, an arylsulfonyl group, an alkylcarbamoyl group, an arylcarbamoyl group, an alkylthiocarbamoyl group, or an arylthiocarbamoyl group.

$R_{14}$ in formula (IVA) or (VA) represents a hydrogen atom, a $C_1$ to $C_{40}$, preferably $C_1$ to $C_{22}$, straight chain or branched chain alkyl, alkenyl, cyclic alkyl, aralkyl or cyclic alkenyl group (which each may have one of the substituents set forth as examples for the above-described substituent $R_{15}$), an aryl group or a heterocyclic ring residue (which each also may have one of the substituents set forth as examples for the above-described substituent $R_{15}$), an alkoxycarbonyl group (e.g., methoxycarbonyl, ethoxycarbonyl, stearyloxycarbonyl, etc.), an aryloxycarbonyl group (e.g., phenoxycarbonyl, naphthoxycarbonyl, etc.), an aralkyloxycarbonyl group (e.g., benzyloxycarbonyl, etc.), an alkoxy group (e.g., methoxy, ethoxy, heptadecyloxy, etc.), an aryloxy group (e.g., phenoxy, tolyloxy, etc.), an alkylthio group (e.g., ethylthio, dodecylthio, etc.), an arylthio group (e.g., phenylthio, α-naphthylthio, etc.), a carboxy group, an acylamino group (e.g., acetylamino, 3-[(2,4-ditert-amylphenoxy)acetamido]benzamido, etc.), a diacylamino group, an N-alkylacylamino group (e.g., N-methylpropionamido, etc.), an N-arylacylamino group (e.g., N-phenylacetamido, etc.), a ureido group (e.g., ureido, N-arylureido, N-alkylureido, etc.), a urethane group, a thiourethane group, an arylamino group (e.g., phenylamino, N-methylanilino, diphenylamino, N-acetylanilino, 2-chloro-5-tetradecanamidoanilino, etc.), an alkylamino group (e.g., n-butylamino, methylamino, cyclohexylamino, etc.), a cycloamino group (e.g., piperidino, pyrrolidino, etc.), a heterocyclic amino group (e.g., 4-pyridylamino, 2-benzoxazolylamino, etc.), an alkylcarbonyl group (e.g., methylcarbonyl, etc.), an arylcarbonyl group (e.g., phenylcarbonyl, etc.), a sulfonamido group (e.g., alkylsulfonamido, arylsulfonamido, etc.), a carbamoyl group (e.g., ethylcarbamoyl, dimethylcarbamoyl, N-methylphenylcarbamoyl, N-phenylcarbamoyl, etc.), a sulfamoyl group (e.g, N-alkylsulfamoyl, N,N-dialkylsulfamoyl, N-arylsulfamoyl, N-alkyl-N-arylsulfamoyl, N,N-diarylsulfamoyl, etc.), a cyano group, a hydroxy group, a mercapto group, a halogen atom or a sulfo group.

$R_{17}$ in general formula (VA) represents a hydrogen atom, or a $C_1$ to $C_{32}$, preferably $C_1$ to $C_{22}$, straight chain or branched chain alkyl, alkenyl, cycloalkyl, aralkyl or cyclic alkenyl group, which each may have one of the substituents set forth as an example for the above-described substituent $R_{15}$.

Further, $R_{17}$ may represent an aryl group or a heterocyclic residue, which each may have one of the substituents set forth as examples for the above-described substituent $R_{15}$.

Furthermore, $R_{17}$ may represent a cyano group, an alkoxy group, an aryloxy group, a halogen atom, a carboxy group, an alkoxycarbonyl group, an aryloxycarbonyl group, an acyloxy group, a sulfo group, a sulfamoyl group, a carbamoyl group, an acylamino group, a diacylamino group, a ureido group, a urethane group, a sulfonamido group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group or a mercapto group.

Substituents $R_{18}$, $R_{19}$ and $R_{20}$ include groups which have been employed in conventional 4-equivalent type phenol or α-naphthol couplers. Specifically, substituent $R_{18}$ represents a hydrogen atom, a halogen atom, an aliphatic hydrocarbon residue, an acylamino group, an —O—$R_{21}$ group or an —S—$R_{21}$ group (wherein $R_{21}$ is an aliphatic hydrocarbon residue). When two or more of $R_{18}$'s are present in one molecular, they may be different from each other. The above-described aliphatic hydrocarbon residues include those having substituents. Substituents $R_{19}$ and $R_{20}$ include aliphatic hydrocarbon residues, aryl groups and heterocyclic ring residues. Either of them may be a hydrogen atom. The above-described substituents may further have certain substituents. Furthermore, $R_{19}$ and $R_{20}$ may combine with each other and form a nitrogen-containing heterocyclic nucleus. l represents an integer of 1 to 4, m represents an integer of 1 to 3, and n represents an integer of 1 to 5. More specifically, the above-described aliphatic hydrocarbon residues include both saturated and unsaturated ones, which each may have a straight chain form, a branched chain form or a cyclic form, with preferable examples including an alkyl group (e.g., methyl, ethyl, propyl, isopropyl, butyl, t-butyl, isobutyl, dodecyl, octadecyl, cyclobutyl, cyclohexyl, etc.) and an alkenyl group (e.g., allyl, octenyl, etc.). The above-described aryl group is a phenyl group, a naphthyl group or the like. Representatives of the above-described heterocyclic ring residues are pyridinyl, quinolyl, thienyl, piperidyl, imidazolyl and the like. These aliphatic hydrocarbon residues, aryl groups and hetero ring residues each may be substituted by a halogen atom, a nitro group, a hydroxy group, a carboxy group, an amino group, a substituted amino group, a sulfo group, an alkyl group, an alkenyl group, an aryl group, a hetero ring residue, an alkoxy group, an aryloxy group, an arylthio group, an arylazo group, an acylamino group, a carbamoyl group, an ester residue, an acyl group, an acyloxy group, a sulfonamido group, a sulfamoyl group, a sulfonyl group, a morpholino group, etc.

Substituents $R_{11}$, $R_{12}$, $R_{13}$, $R_{14}$, $R_{15}$, $R_{17}$, $R_{18}$, $R_{19}$ and $R_{20}$ in the couplers represented by general formulae (IA) to (VIIIA) may combine with their respective corresponding substituents, or one of them may become a divalent group to form a symmetric or an asymmetric complex coupler.

Specific examples of the DIR couplers which can be effectively used in the present invention are illustrated below.

D-1

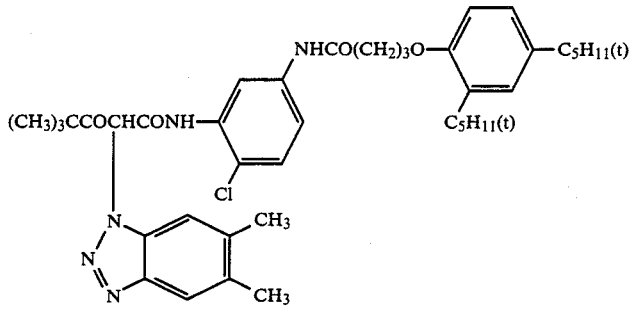

D-2

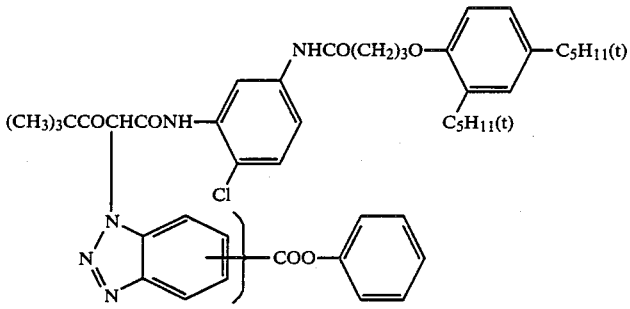

D-3

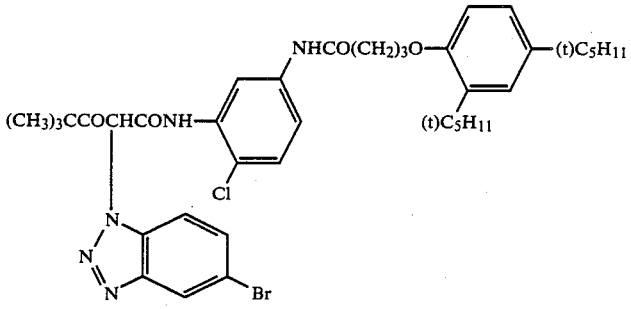

D-4

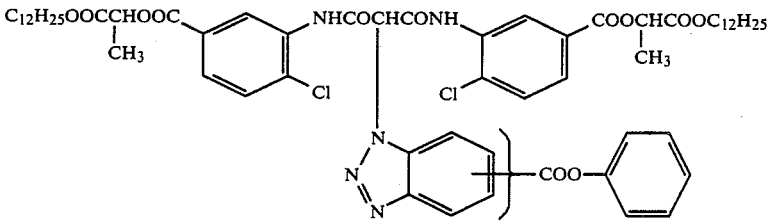

D-5

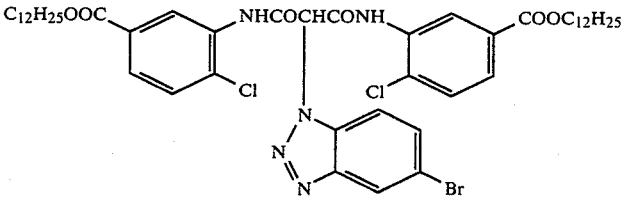

-continued
D-6
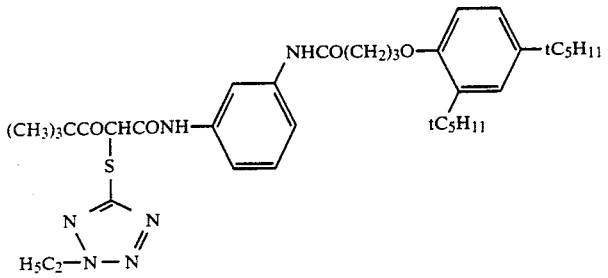
D-7
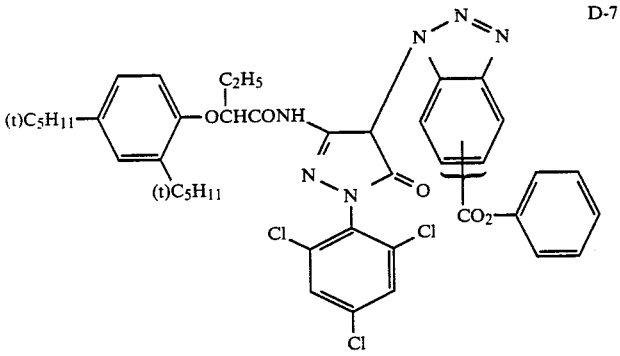
D-8
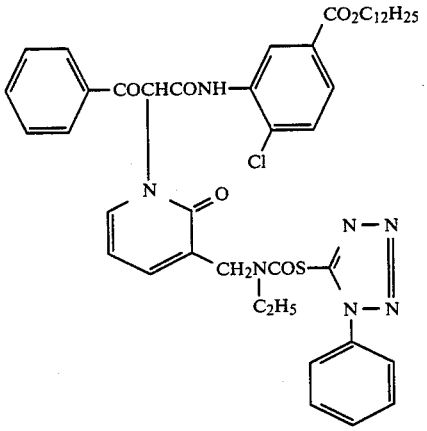
D-9
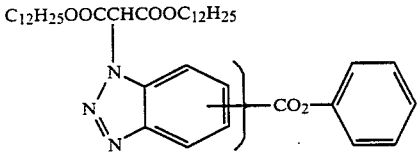
D-10
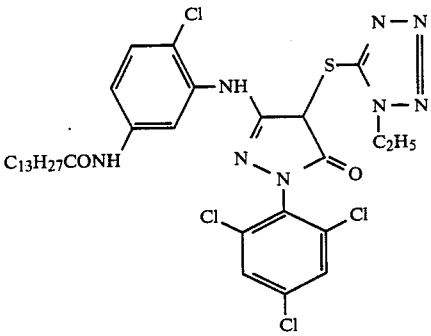
D-11
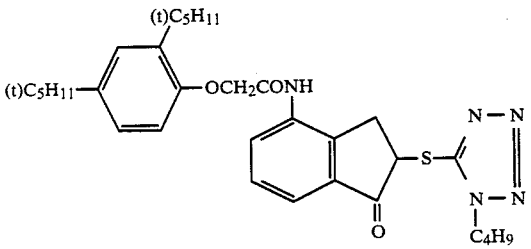
D-12
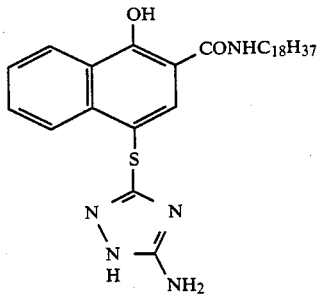

-continued
D-13
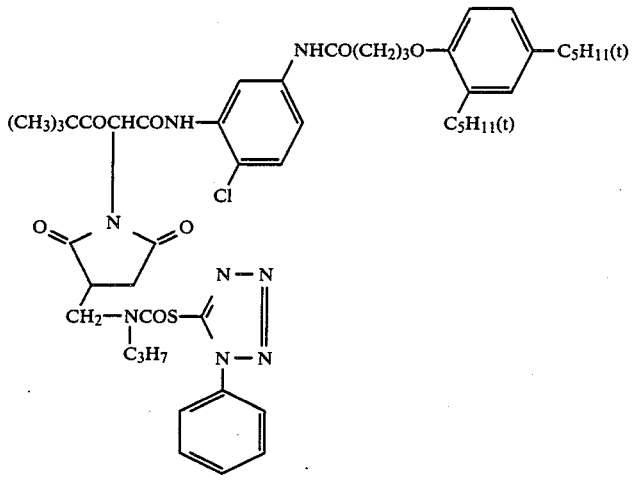
D-14
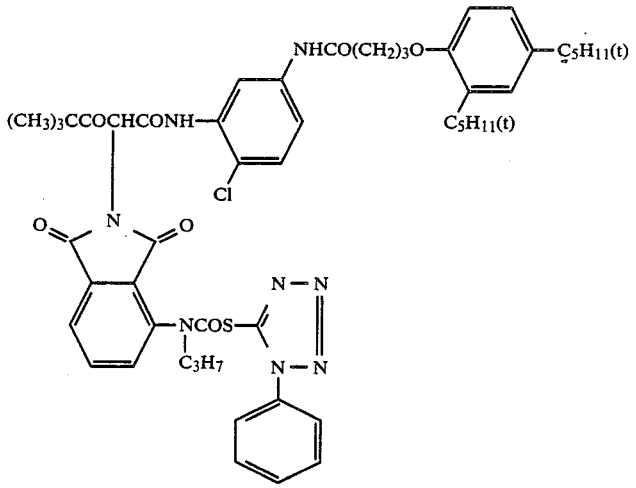
D-15
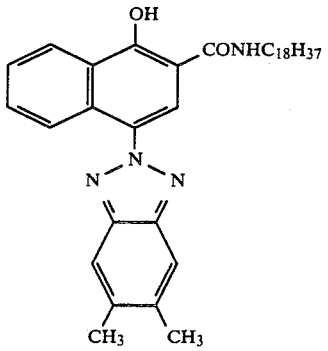
D-16
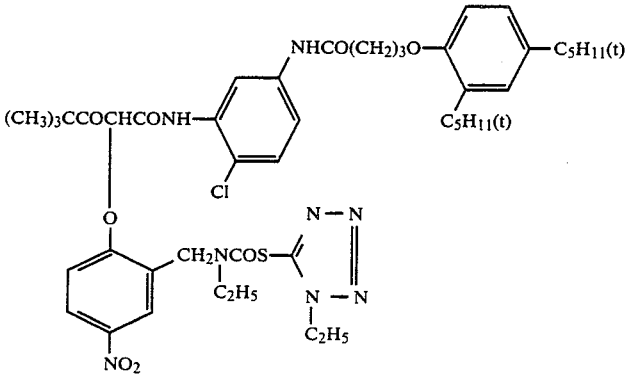

-continued
D-17
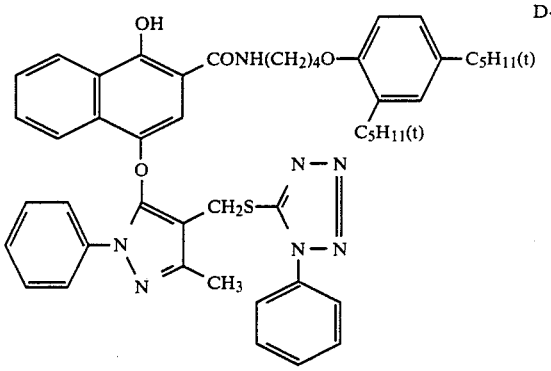
D-18
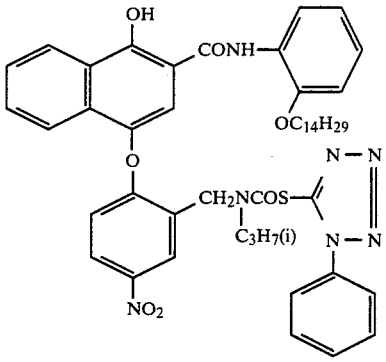
D-19
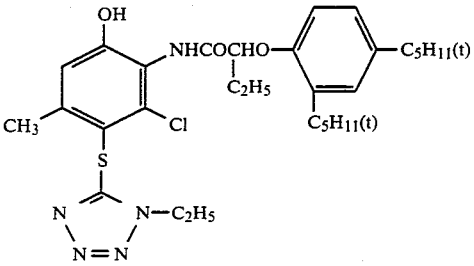
D-20
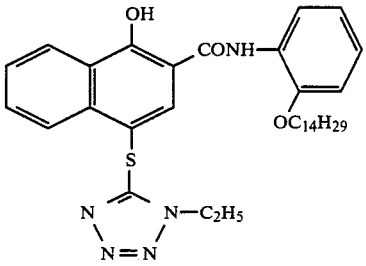
D-21
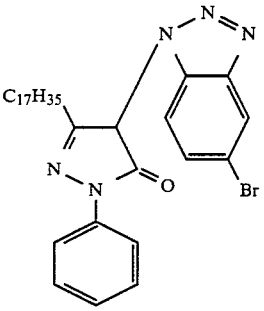
D-22
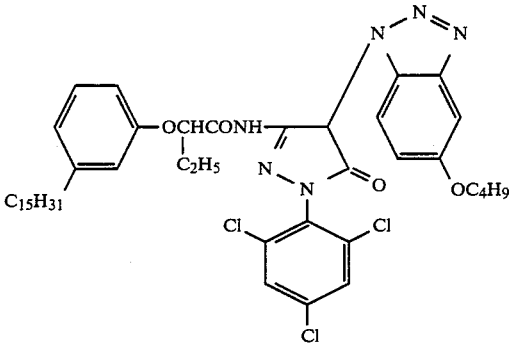
D-23
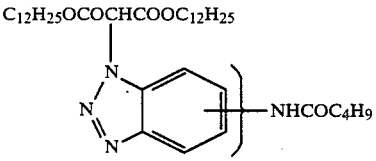
D-24
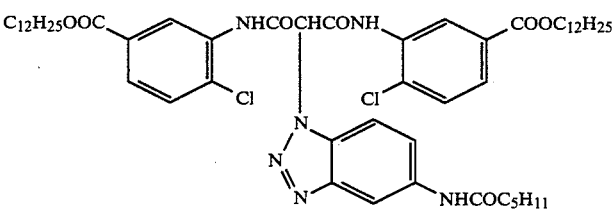
D-25
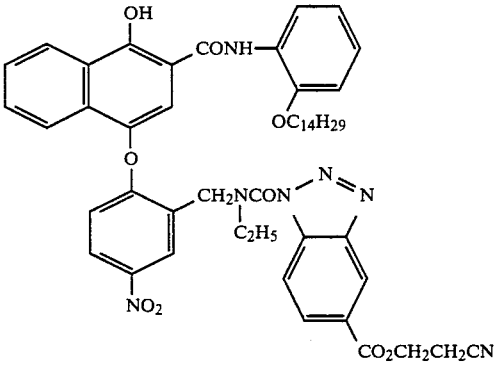
D-26
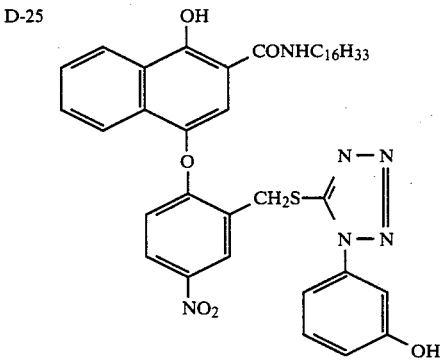

-continued
D-27
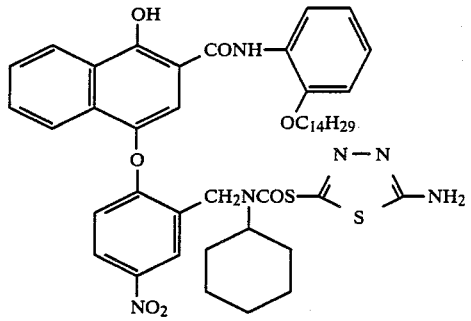
D-28
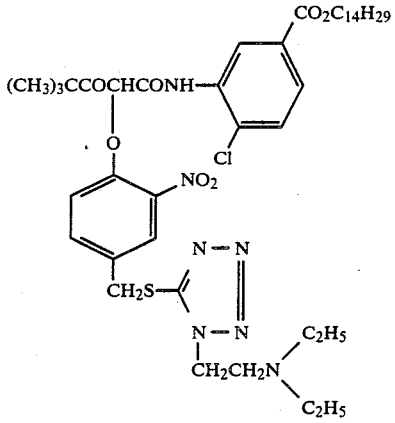
D-29
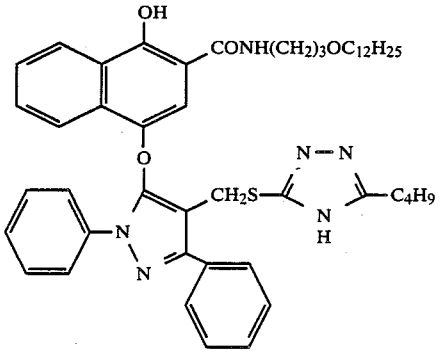
D-30
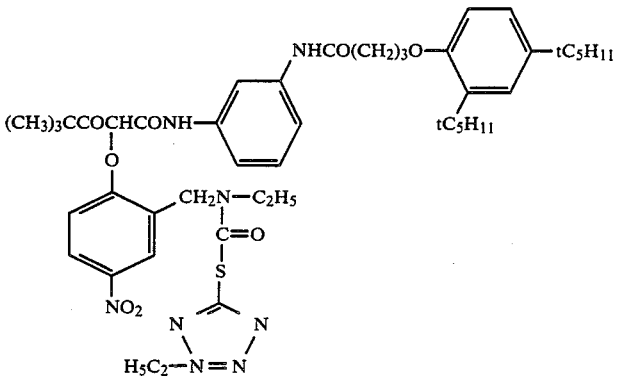
D-31
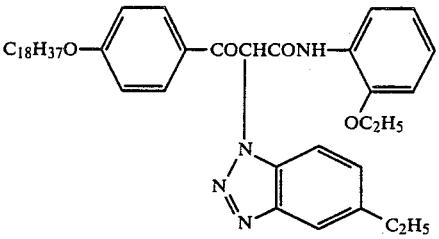
D-32
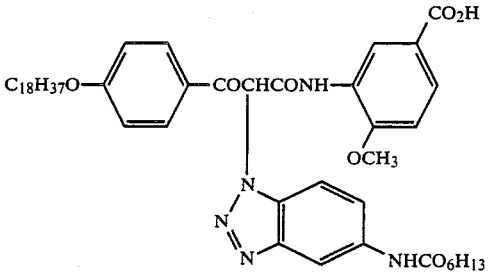
D-33
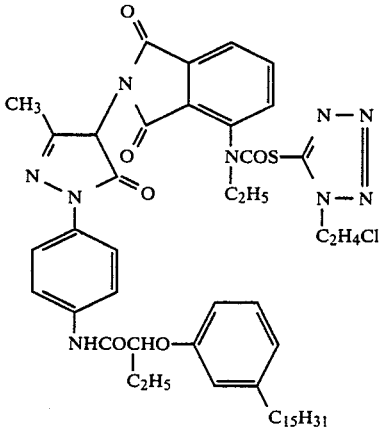
D-34
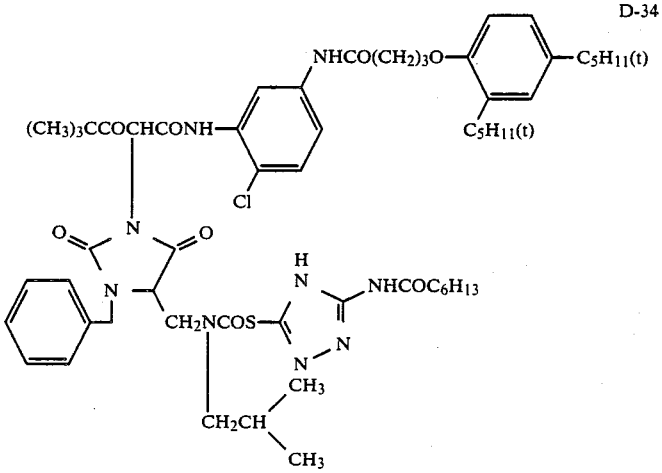

-continued
D-35
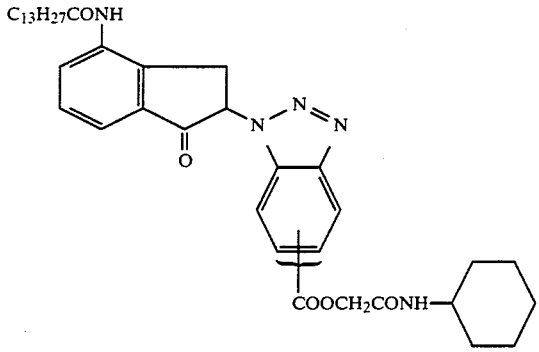
D-36
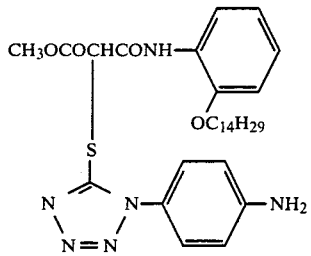
D-37
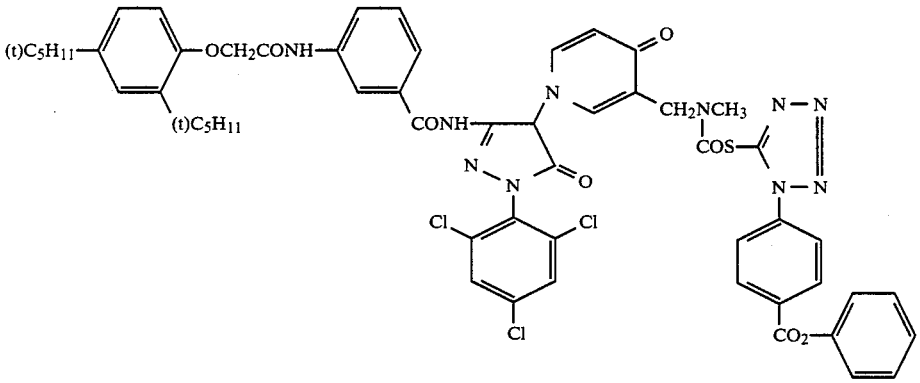
D-38
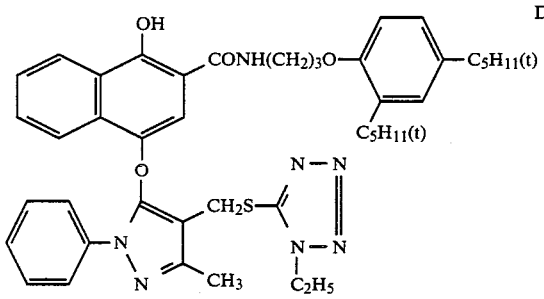
D-39
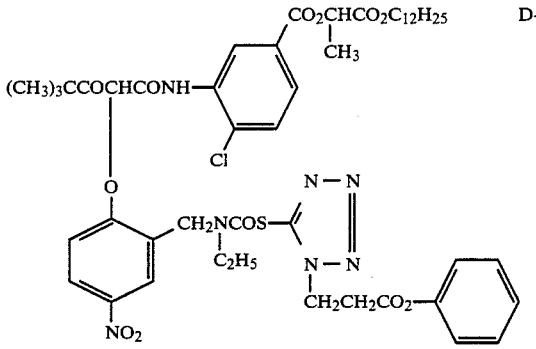
D-40
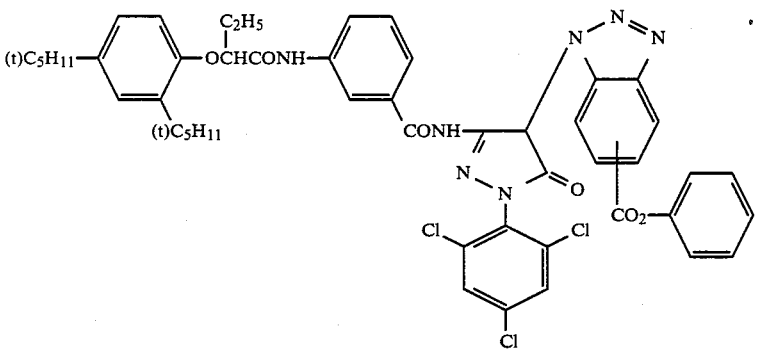

-continued
D-41
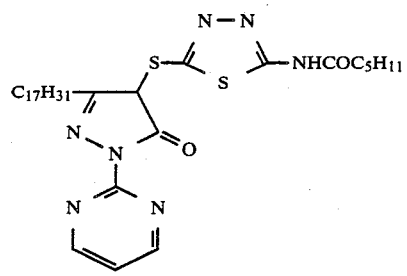
D-42
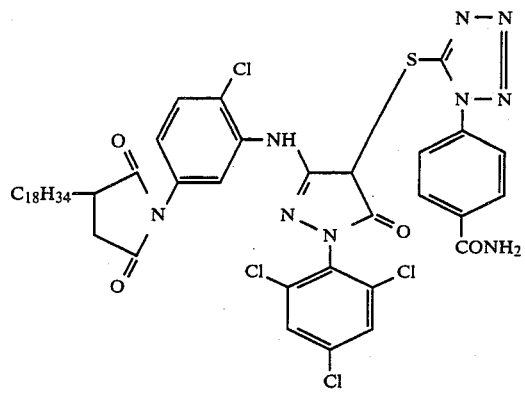
D-43
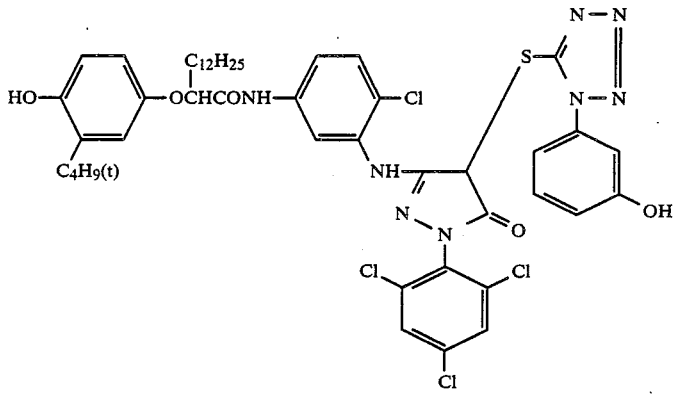
D-44
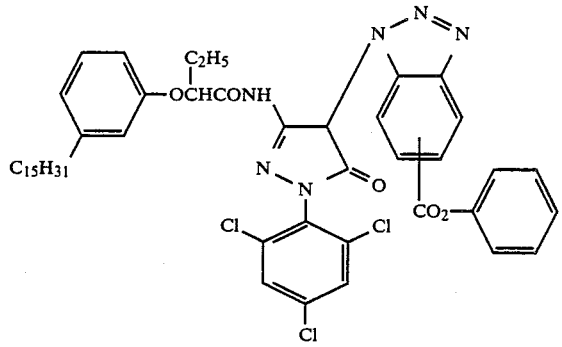
D-45
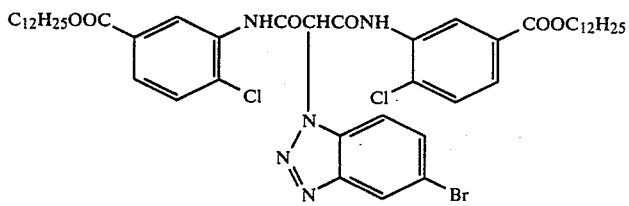

-continued

D-46

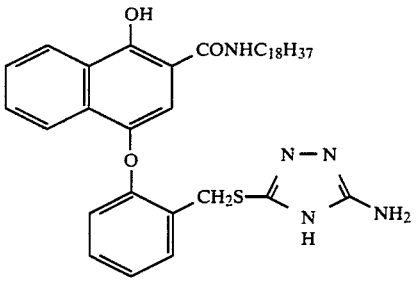

D-47

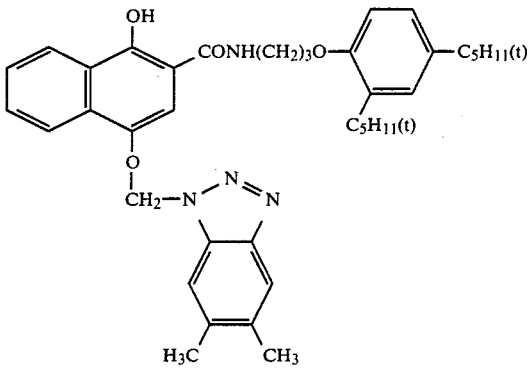

These compounds employed in the present invention can be easily synthesized using the methods described in, e.g., U.S. Pat. Nos. 4,234,678, 3,227,554, 3,617,291, 3,958,993, 4,149,886 and 3,933,500, Japanese Patent Application (OPI) Nos. 56837/82 and 13239/76, British Pat. Nos. 2,072,363 and 2,070,266, *Research Disclosure,* No. 21228, Dec., 1981, and so on.

The diffusibilities of the DIR couplers employed in the present invention are preferably about 0.4 or more. More preferably, the diffusibilities are not higher than about 1.0. When the diffusibilities are extremely heightened, the visual sharpness tends to decrease.

Polymer couplers which can be employed in the present invention are derived from monomeric couplers represented by the following general formula (CI), and they are preferably homopolymers having repeating units represented by the following general formula (CII), or copolymers of the above-described monomeric couplers and one or more non-coloring monomers containing at least one ethylenic double bond that do not undergo an oxidative coupling reaction with an aromatic primary amine developer. Thus, two or more kinds of the above-described monomeric couplers may take part in the polymerization reaction at the same time.

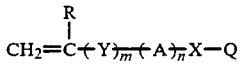

(CI)

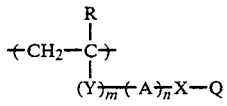

(CII)

wherein R represents a hydrogen atom, a lower ($C_1$ to $C_4$) alkyl group or a chlorine atom; X represents —CONH—, —NHCONH—, —NHCOO—, —COO—, —$SO_2$—, —CO— or —O—; Y represents —CONH— or —COO—; A represents a $C_1$ to $C_{10}$ substituted or unsubstituted alkylene group, an aralkylene group, or an unsubstituted or substituted arylene group, wherein the alkylene group may be straight chain or a branched chain; examples of such an alkylene group include methylene, methylmethylene, dimethylmethylene, dimethylene, trimethylene, tetramethylene, pentamethylene, hexamethylene, decylmethylene, etc., examples of such an aralkylene group include benzilidene, etc., and examples of such an arylene group include phenylene, naphthylene, etc.; Q represents a cyan color forming coupler residue, a magenta color forming coupler residue or a yellow color forming coupler residue, which can form the corresponding dye by coupling with the oxidation product of an aromatic primary amine developing agent; and m and n each represents 0 or 1.

Substituents for the alkylene group or the phenylene group represented by A include an aryl group (e.g., phenyl), a nitro group, a hydroxy group, a cyano group, a sulfo group, an alkoxy group (e.g., methoxy), an aryloxy group (e.g., phenoxy), an acyloxy group (e.g., acetoxy), an acylamino group (e.g., acetylamino), a sulfonamido group (e.g., methanesulfonamido), a sulfamoyl group (e.g., methylsulfamoyl), a halogen atom (e.g., fluorine, chlorine, bromine, etc.), a carboxy group, a carbamoyl group (e.g., methylcarbamoyl), an alkoxycarbonyl group (e.g., methoxycarbonyl) and a sulfonyl group (e.g., methylsulfonyl). When the alkylene group and the phenylene group have two or more substituents, the substituents may be the same or different.

Preferable examples of the cyan color forming coupler residue are those of the phenol type represented by formula (CIII) or those of the naphthol type represented by formula (CIV):

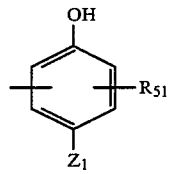

(CIII)

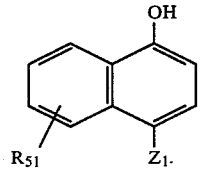

(CIV)

wherein $R_{51}$ represents a hydrogen atom, an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an arylcarbamoyl group, an arylamido group, an arylsulfamoyl group, an arylsulfonamido group or an arylureido group, and if the coupler residue has two or more $R_{51}$ group, they may be the same or different; and $Z_1$ represents a hydrogen atom, a halogen atom, a sulfo group, an acyloxy group, an alkoxy group, an aryloxy group, a heterocyclic oxy group, an alkylthio group, an arylthio group or a heterocyclic thio group, which each may further be substituted with a substituent such as an aryl group (e.g., phenyl), a nitro group, a hydroxy group, a cyano group, a sulfo group, an alkoxy group (e.g., methoxy), an aryloxy group (e.g., phenoxy), an acyloxy group (e.g., acetoxy), an acylamino group (e.g., acetylamino), a sulfonamido group (e.g., methanesulfonamido), a sulfamoyl group (e.g., methylsulfamoyl), a halogen atom (e.g., fluorine, chlorine, bromine, etc.), carboxy group, a carbamoyl group (e.g., methylcarbamoyl), an alkoxycarbonyl group (e.g., methoxycarbonyl, etc.), a sulfonyl group (e.g., methylsulfonyl) and so on.

As for the magenta color forming coupler residue, those of pyrazolone type or those of indazolone type are preferably used. Specific examples thereof include those having the following general formula (CV):

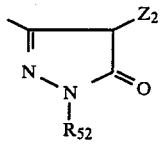

(CV)

wherein $R_{52}$ represents a substituent of the well known type which is located at the 1-position of a 2-pyrazoline-5-one coupler, such as an alkyl group, a substituted alkyl group (e.g., haloalkyl such as fluoroalkyl, cyanoalkyl, benzylalkyl, etc.), an aryl group or a substituted aryl group [which has one or more (the same or different) substituents, with specific examples of the substituents including an alkyl group (e.g., methyl, ethyl, etc.), an alkoxy group (e.g., methoxy, ethoxy, etc.), an aryloxy group (e.g., phenyloxy), an alkoxycarbonyl group (e.g., methoxycarbonyl, etc.), an acylamino group (e.g., acetylamino), a carbamoyl group, an alkylcarbamoyl group (e.g., methylcarbamoyl, ethylcarbamoyl, etc.), a dialkylcarbamoyl group (e.g., dimethylcarbamoyl), an arylcarbamoyl group (e.g., phenylcarbamoyl), an alkylsulfonyl group (e.g., methylsulfonyl), an arylsulfonyl group (e.g., phenylsulfonyl), an alkylsulfonamido group (e.g., methanesulfonamido), an arylsulfonamido group (e.g., phenylsulfonamido), a sulfamoyl group, an alkylsulfamoyl group (e.g., ethylsulfamoyl), dialkylsulfamoyl group (e.g., dimethylsulfamoyl), an alkylthio group (e.g., methylthio), an arylthio group (e.g., phenylthio), a cyano group, a nitro group and a halogen atom (e.g., fluorine, chlorine, bromine, etc.), among which a halogen atom, an alkyl group, an alkoxy group, an alkoxycarbonyl group and a cyano group are especially preferable]; and $Z_2$ represents a hydrogen atom or a splitting-off group which binds to the coupling site through an oxygen atom, a nitrogen atom or a sulfur atom which the group contains, which atoms each is attached to an alkyl group, an aryl group, an alkylsulfonyl group, an arylsulfonyl group, an alkylcarbonyl group, an arylcarbonyl group or a heterocyclic nucleus (wherein the alkyl group, the aryl group and the heterocyclic nucleus each may have a substituent such as those set forth as the substituents for the aryl group represented by the above-described $R_{52}$), and when the splitting-off group is attached to the coupling site through a nitrogen atom, it may further include atoms capable of forming 5- or 6-membered ring together with the nitrogen atom, e.g., an imidazolyl group, a pyrazolyl group, a triazolyl group, a tetrazolyl group or the like.

As for the yellow color forming coupler residue, those of acetoacetanilide type, especially of the pivaloylacetanilide type represented by general formula (CVI) and those of the benzoylacetanilide type represented by general formula (CVII) or (CVIII) are preferred:

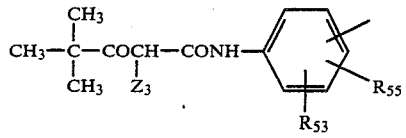

(CVI)

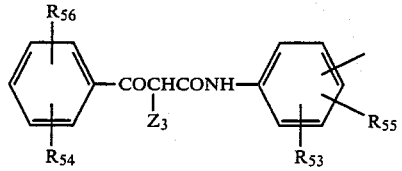

(CVII)

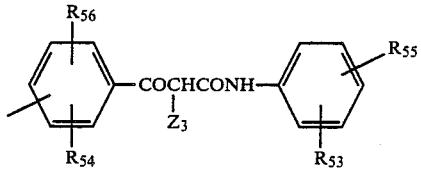

(CVIII)

wherein $R_{53}$, $R_{54}$, $R_{55}$ and $R_{56}$ each represents a hydrogen atom or a substituent well known in conventional yellow color forming coupler residues, e.g., an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an alkyl-substituted succinimido group, an aryloxy group, an aryloxycarbonyl group, an arylcarbamoyl group, an arylamido group, an arylsulfamoyl group, an arylsulfonamido group, an arylureido group, a carboxy group, a sulfo group, a nitro group, a cyano group, a thiocyano group and so on, and these substituents may be the same or different from one another; and $Z_3$ represents a hydrogen atom or a moiety represented by the following general formula (CIX), (CX), (CXI) or (CXII):

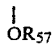

(CIX)

wherein $R_{57}$ represents an aryl group, which may have a substituent, or a heterocyclic nucleus.

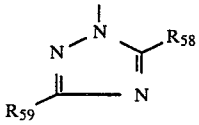

(CX)

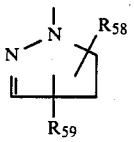

(CXI)

wherein $R_{58}$ and $R_{59}$ may be the same or different, and they each represents a hydrogen atom, a halogen atom, a carboxylic acid ester group, an amino group, an alkyl group, an alkylthio group, an alkoxy group, an alkylsulfonyl group, an alkylsulfinyl group, a carboxyl group, a sulfonyl group, a non-substituted or substituted phenyl group, or a heterocyclic ring residue.

(CXII)

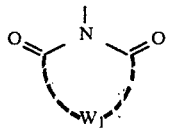

wherein $W_1$ represents the non-metallic atoms (e.g., carbon, oxygen, nitrogen and sulfur) necessary to complete a 4-, 5- or 6-membered ring together with the moiety

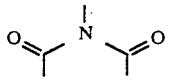

Among substituents represented by general formula (CXII) for $Z_3$, those represented by the following general formulae (CXIII), (CXIV) and (CXV) are more advantageous:

(CXIII)

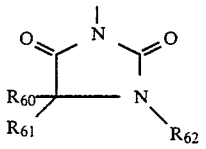

(CXIV)

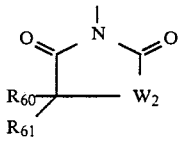

(CXV)

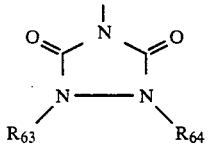

wherein $R_{60}$ and $R_{61}$ each represents a hydrogen atom, an alkyl group, an aryl group, an alkoxy group, an aryloxy group or a hydroxy group; $R_{62}$, $R_{63}$ and $R_{64}$ each represents a hydrogen atom, an alkyl group, an aryl group, an aralkyl group or an acyl group; and $W_2$ represents an oxygen atom or a sulfur atom.

Non-coloring ethylenic monomers which cannot undergo a coupling reaction with the oxidation product(s) of an aromatic primary amine developers are described in detail below. Suitable examples thereof include acrylic acid, α-chloroacrylic acid, an α-alacrylic acid (e.g., methacrylic acid) and esters or amides derived from these acrylic acids (e.g., acrylamide, n-butylacrylamide, t-butylacrylamide, diacetone acrylamide, methacrylamide, methylacrylate, ethylacrylate, n-propylacrylate, n-butylacrylate, t-butylacrylate, isobutylacrylate, 2-ethylhexylacrylate, n-octylacrylate, laurylacrylate, methylmethacrylate, ethylmethacrylate, n-butylmethacrylate and β-hydroxymethacrylate), methylenedibisacrylamide, vinyl esters (e.g., vinyl acetate, vinyl propionate and vinyl laurate), acrylonitrile, methacrylonitrile, aromatic vinyl compounds (e.g., styrene and its derivatives, vinyltoluene, divinylbenzene, vinylacetophenone and sulfostyrene), itaconic acid, citraconic acid, crotonic acid, vinylidene chloride, vinyl alkyl ethers (e.g., vinyl ethyl ether), maleic acid, maleic anhydride, maleic acid esters, N-vinyl-2-pyrrolidone, N-vinylpyridine, 2- and 4-vinylpyridines, and so on.

Upon copolymerization, two or more of the above-described non-coloring ethylenic unsaturated monomers may be used at the same time. Suitable examples of a combination of such monomers include the combination of n-butylacrylate and methylacrylate, styrene and methacrylic acid, methacrylic acid and acrylamide, methylacrylate and diacetoneacrylamide, and so on.

As is well known in the art of polymeric color couplers, non-coloring ethylenic unsaturated monomers copolymerized with solid water-insoluble monomer couplers should be selected so as to have a good influences on the physical and chemical properties of the resulting copolymer, e.g., solubility of the resulting copolymer, compatibility with a binder for a photographic colloidal composition, such as gelatin, flexibility and thermal stability of the resulting copolymer, and so on.

Polymer couplers employed in the present invention may be either water-soluble or water-insoluble, but they give especially good results when used in the form of polymer coupler latex.

The polymer coupler latex may be prepared by removing a hydrophilic polymer coupler synthesized by polymerization of monomeric coupler(s) from the reaction system, dissolving the polymer coupler in an organic solvent and then dispersing the resulting solution in the form of latex; or by directly dispersing an oleophilic polymer coupler solution obtained by polymerization in the form of latex. On the other hand, a polymer coupler latex prepared by emulsion polymerization or a polymer coupler latex having a layer structure may be directly added to a gelatin silver halide emulsion.

Water-soluble polymer couplers can be synthesized using methods as described in, e.g., U.S. Pat. Nos. 3,155,510, 3,221,552 and 3,299,013, *Research Disclosure,* No. 19033 (Vol. 190), and so on. In the case where oleophilic polymer couplers are dispersed into aqueous gelatin solutions in the form of a latex, the polymer coupler latexes can be prepared using the method described in U.S. Pat. No. 3,451,820; and in the case where polymer coupler latexes synthesized by emulsion polymerization are directly dispersed into gelatin silver halide emulsions, the polymer coupler latexes can be prepared according to the methods described in U.S. Pat. Nos. 4,080,211, 3,370,952, 3,926,346 and 3,767,412, and British Pat. No. 1,247,688.

The above-described methods can be applied to the formation of a homopolymer or a copolymer per the present invention.

Free radical polymerization of ethylene series unsaturated solid monomers can be initiated by addition of free radicals to the monomer molecules, the free radicals being formed by pyrolysis of a chemical initiator, the action of a reducer or an oxidizing compound (a redox initiator), or a physical action, such as irradiation with ultraviolet rays or other high energy beams or high frequency waves.

Chemical initiators which can be employed in free radical polymerization include persulfates (e.g., ammonium persulfate and potassium persulfate), hydrogen peroxide, 4,4'-azobis(4-cyanovalerianic acid and the like (which all are water-soluble), azobisisobutyronitriles (e.g., 2,2'-azobisisobutyronitrile, 2,2'-azobis(2,4-dimethylvaleronitrile), benzoyl peroxide, chlorobenzoyl peroxide and so on (the foregoing are water-insoluble).

Examples of redox initiators which are usually used include the combination of hydrogen peroxide with ferrous salts, the combination of potassium persulfate with potassium hydrogensulfate, cerium alkoxide, etc.

As for the above-described initiators, their examples and actions are described in F. A. Bovey, *Emulsion Polymerization,* pages 59–93, Interscience Publishers Inc., New York (1955).

It is desirable for the solvents to be used in such polymerizations to have properties such that they can be mixed with monomers in all proportions and, at the same time, are good solvents for the polymer couplers to be produced and that they do not react with an initiator used and do not interfere with the free radical addition polymerization. Specific examples of such solvents include water, aromatic hydrocarbons (e.g., benzene, toluene, etc.), aliphatic hydrocarbons (e.g., n-hexane, etc.), alcohols (e.g., methanol, ethanol, isopropanol, tert-butanol, etc.), ketones (e.g., acetone, methyl ethyl ketone, etc.), cyclic ethers (e.g., tetrahydrofuran, dioxane, etc.), esters (e.g., ethyl acetate, etc.), chlorinated hydrocarbons (e.g., methylene chloride, chloroform, etc.), amides (e.g., dimethylformamide, dimethylacetamide, etc.), sulfoxides (e.g., dimethyl sulfoxide, etc.), nitriles (e.g., acetonitrile, etc.) and combinations of two or more thereof.

However, in case of emulsion polymerization of water-insoluble solid monomeric couplers, water or a water/organic solvent mixed system is used as a solvent. Suitable organic solvents employable in such systems are those having such properties that: (1) they are substantially inert to the solid, water-insoluble monomeric couplers; (2) they do not interfere with the free radical addition polymerization; and (3) they have low boiling points and, therefore, they can be readily removed from the aqueous reaction medium in the course of and/or after the polymerization. Specific examples of such solvents include lower alcohols having 1 to 4 carbon atoms (e.g., methanol, ethanol and isopropanol), ketones (e.g., acetone), chlorinated hydrocarbons (e.g., chloroform), aromatic hydrocarbons, (e.g., benzene), cyclic ethers (e.g., tetrahydrofuran), esters (e.g., ethyl acetate), nitriles (e.g., acetonitrile) and the like.

The polymerization temperature should be selected depending on the molecular weight of the polymer to be produced, the kind of initiator used and so on. Though it is possible to set the polymerization temperature at 0° C. to 100° C., polymerization is usually conducted at a temperature of 30° C. to 100° C.

Organic solvents employed for dissolving oleophilic polymer couplers in the case where oleophilic polymer couplers are to be dispersed into a gelatin water solution in the form of a latex are removed before coating the dispersion, or, though not preferred, upon vaporization in the course of drying the coated dispersion.

Removal of solvents can be carried out using the noodle-washing method if they have some degree of water solubility, by the spray drying method or by the vacuum or the steam purging method.

Organic solvents which can be removed using the above-described methods include lower alkyl esters, lower alkyl esters, ketones, chlorinated hydrocarbons such as methylene chloride and trichloroethylene, fluorinated hydrocarbons, alcohols such as n-butyl alcohol and n-octyl alcohol, and combinations of two or more thereof.

Dispersing agents which can be employed for dispersing oleophilic polymer couplers include all types of surface active agents. However, ionic surface active agents, especially anionic ones, are preferably employed.

Further, amphoteric surface active agents such as C-cetylbetaine, N-alkylaminopropionates, N-alkyliminodipropionate and the like can be also employed for the above-described purpose.

Emulsifiers employed in directly preparing polymer coupler latexes by emulsion polymerization include compounds having surface activity, such as soaps, sulfonates, sulfates, cationic compounds, amphoteric compounds and macromolecular protective colloids. Specific examples and actions of the compounds belonging to each of the above-described groups are described in *Belgische Chemische Industrie, Vol.* 28, pp. 16–20, (1963).

In addition, permanent solvents, that is, water-immiscible high boiling point (higher than 200° C.) solvents, may be added for the purposes of controlling the hue of a dye to be produced by the coupling of a polymer coupler with an oxidation product of an aromatic primary amine developer, thus improving the flexibility of the emulsion coated. It is desirable to lower the concentration of such a permanent solvent in order to maintain high sharpness by rendering the final thickness of the emulsion layers as thin as possible.

Usually, the proportion which a coloring moiety has in a polymer coupler is desirably 5 to 80 wt%. However, proportions within the range of 20 to 70 wt% are especially advantageous from the viewpoints of color reproducibility, color developability and stability. In such case, an equivalent molecular weight (the gram number of a polymer containing 1 mol of monomeric coupler) ranges from about 250 to 4,000. However, the present invention should not be construed as being limited to such a range.

Examples of monomeric couplers suitable for preparing polymer couplers by polymerizing them in accordance with embodiments of the present invention, and synthesis methods thereof, can be found in various literature, e.g., Belgian Pat. Nos. 584,494, 602,516 and 669,971, British Pat. Nos. 967,503, 1,130,581, 1,247,688 and 1,269,355, U.S. Pat. Nos. 3,356,686 and 3,767,412, and Japanese Patent Application Nos. 171544/80, 68979/81, 109056/81, 140667/81 and 2419/82.

In addition, the synthesis methods and the monomer couplers described in the specifications of Japanese Patent Application Nos. 95797/82 and 120857/82 can be also applied to the present invention.

Representative monomeric couplers are illustrated below. However, the present invention should not be construed as being limited to these examples.

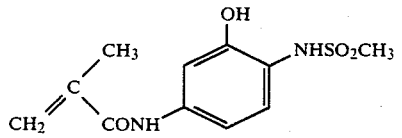

(C-1)

-continued
(C-2)
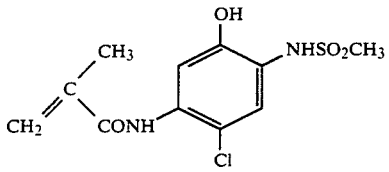
(C-3)
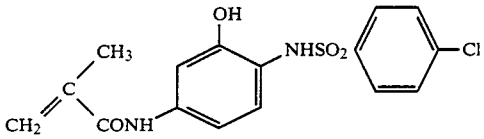
(C-4)
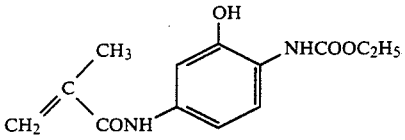
(C-5)
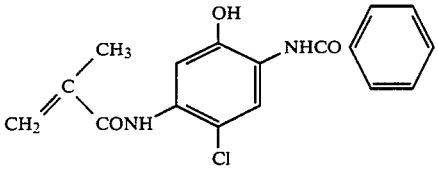
(C-6)
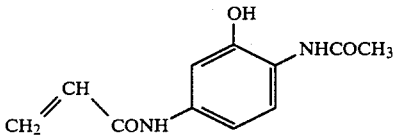
(C-7)
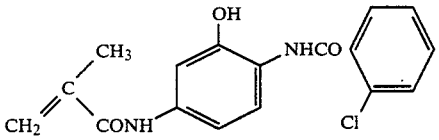
(C-8)
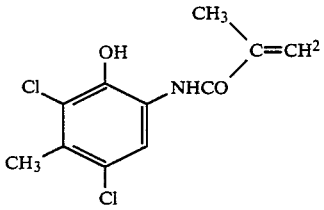
(C-9)
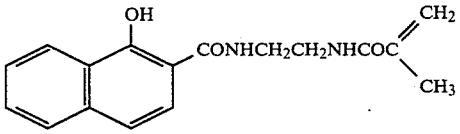
(C-10)
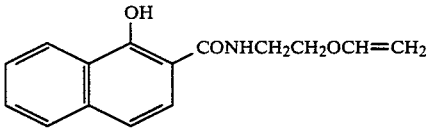
(C-11)
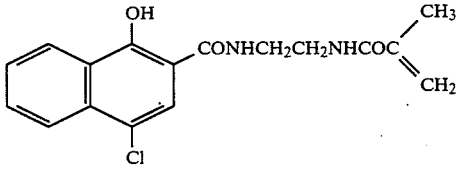
-continued
(C-12)
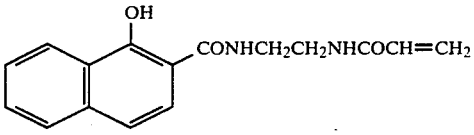
(C-13)
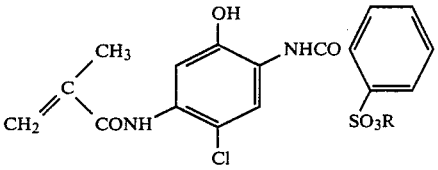
(C-14)
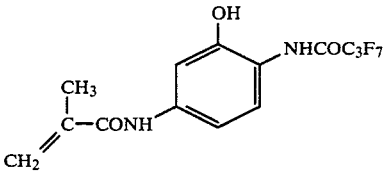
(C-15)
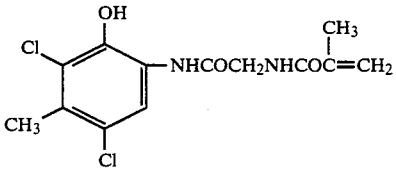
(C-16)
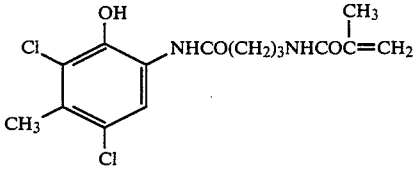
(C-17)
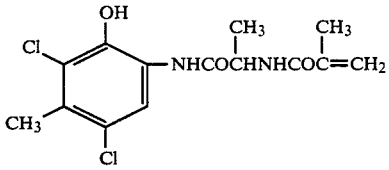
(C-18)
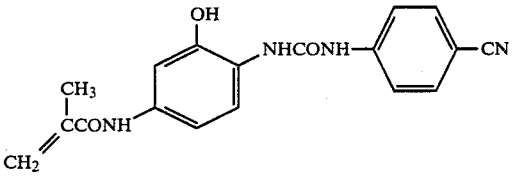
(M-1)
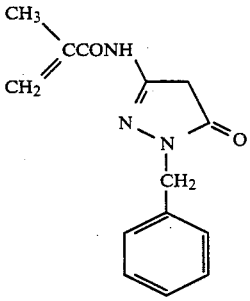

-continued
(M-2)
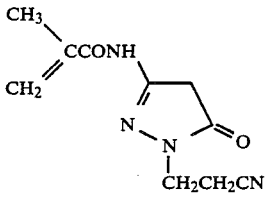
(M-3)
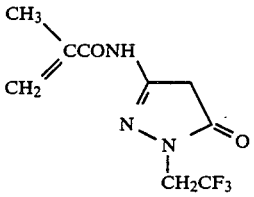
(M-4)
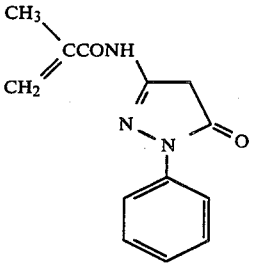
(M-5)
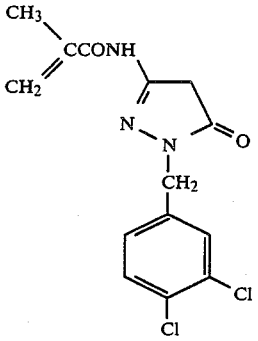
(M-6)
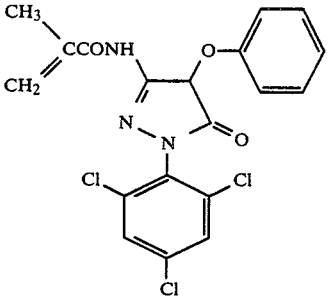
(M-7)
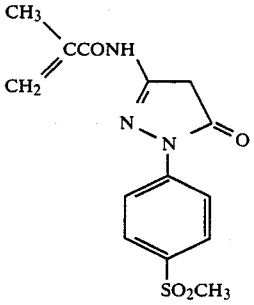
-continued
(M-8)
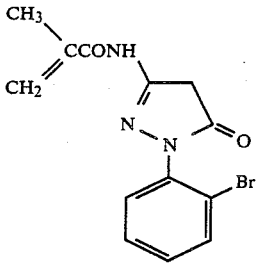
(M-9)
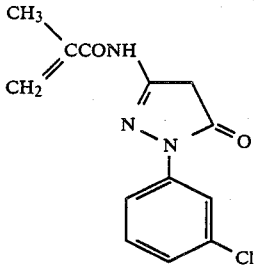
(M-10)
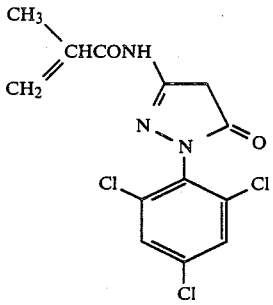
(M-11)
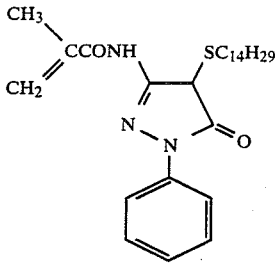
(M-12)
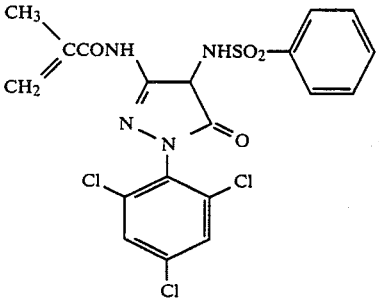

-continued
(M-13)
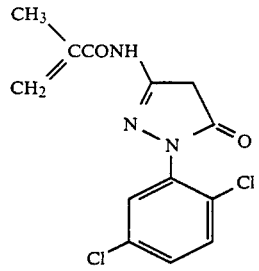
(M-14)
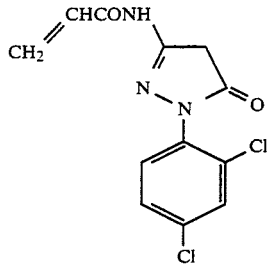
(M-15)
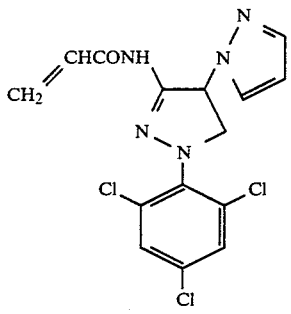
(M-16)
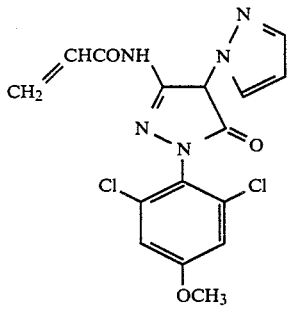
(M-17)
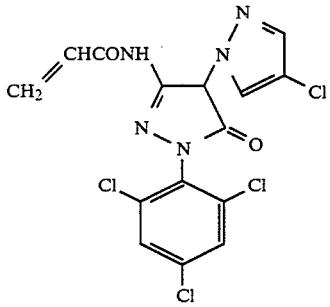
-continued
(M-18)
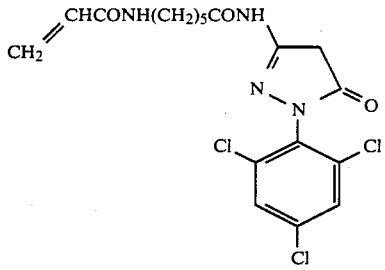
(M-19)
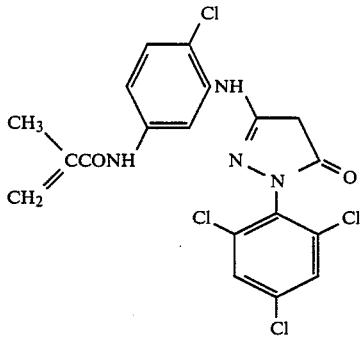
(M-20)
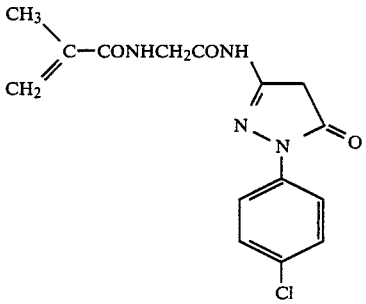
(M-21)
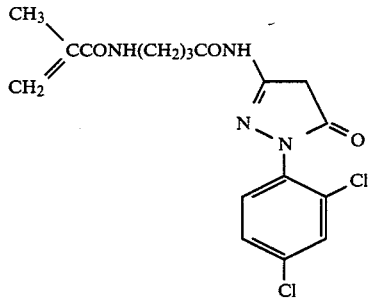
(M-22)
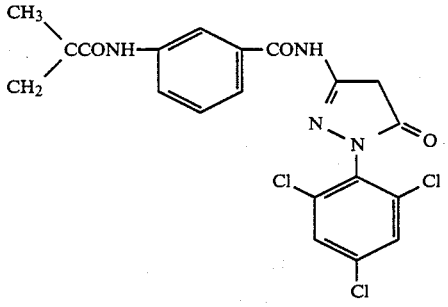

-continued
(M-23)
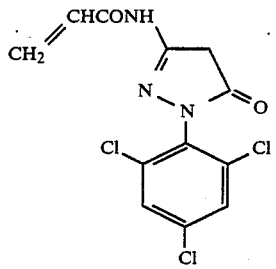
(M-24)
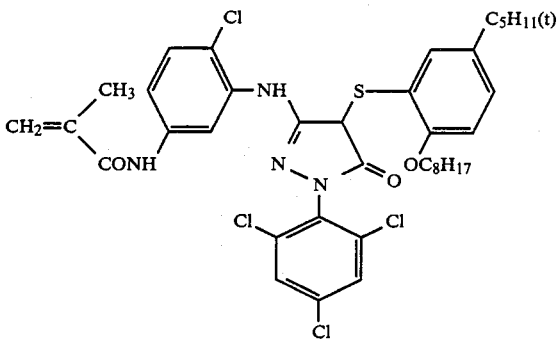
(M-25)
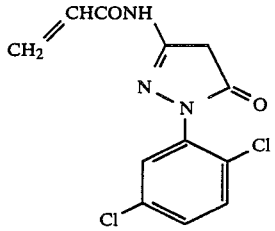
(M-26)
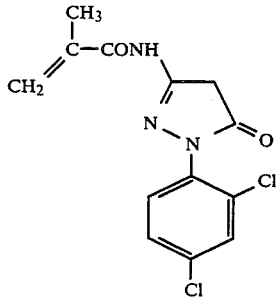
(M-27)
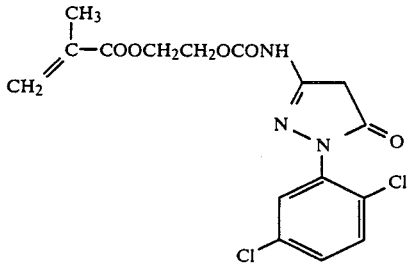
-continued
(M-28)
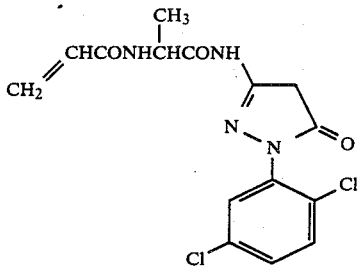
(M-29)
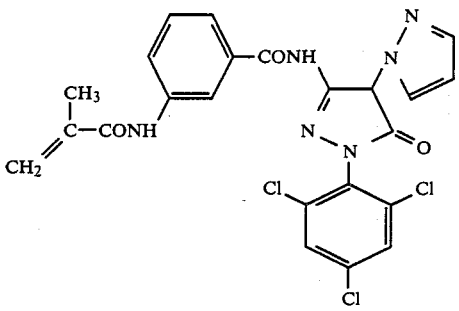
(M-30)
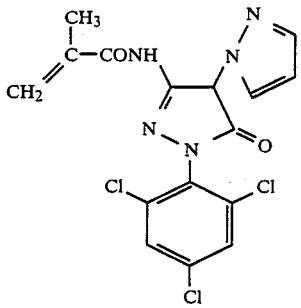
(M-31)
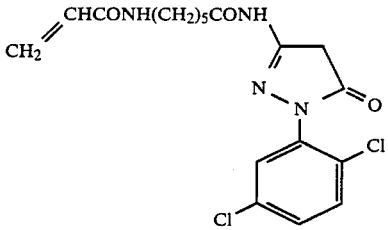
(Y-1)
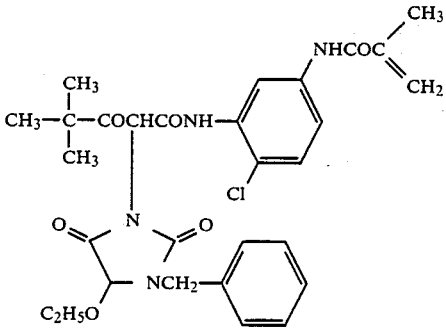

-continued
(Y-2)
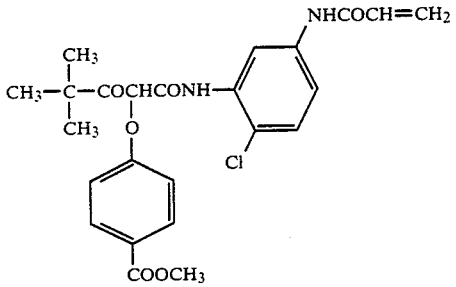
(Y-3)
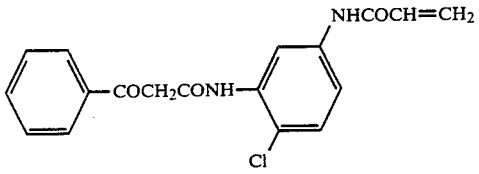
(Y-4)
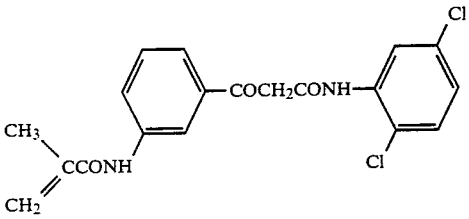
(Y-5)
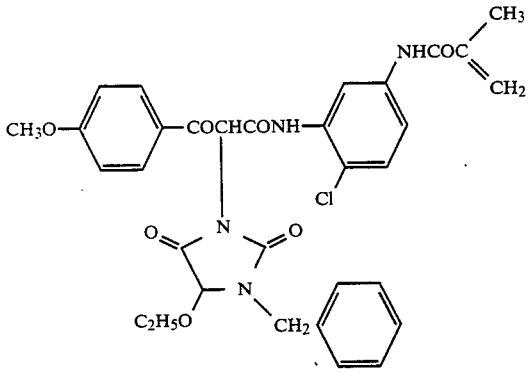
(Y-6)
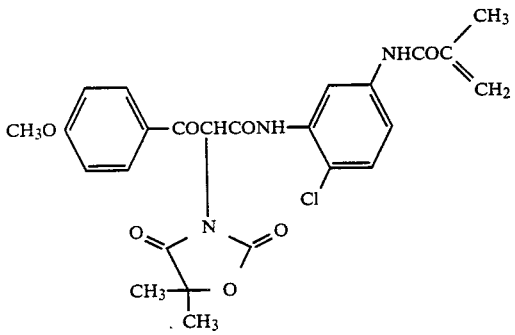
-continued
(Y-7)
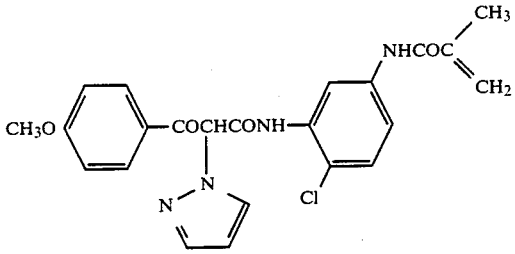
(Y-8)
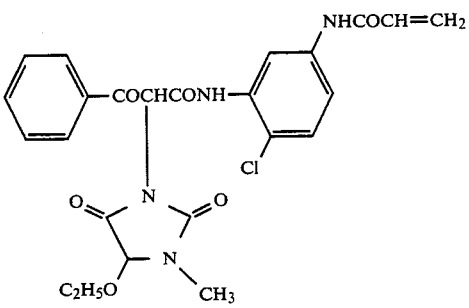
(Y-9)
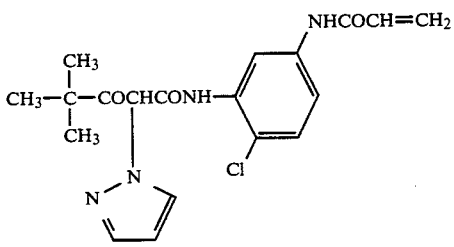
(Y-10)
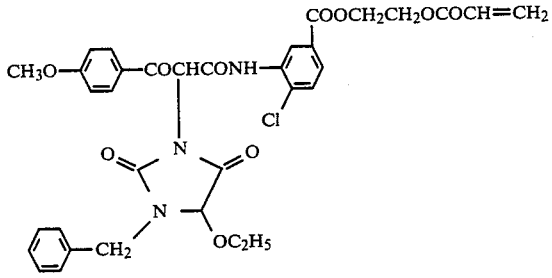
(Y-11)
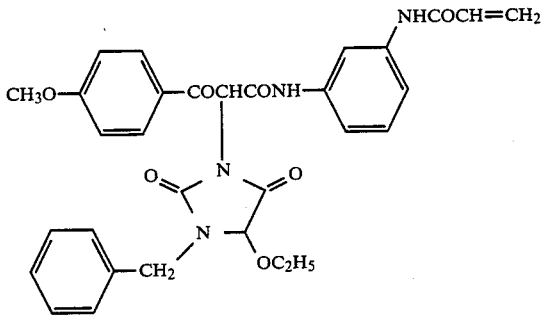
Methods of synthesizing polymer compounds and specific polymer coupler latexes obtained using such methods are described in detail below.

SYNTHESIS EXAMPLE 11

Polymer coupler latex (Latex Coupler (A)) obtained by copolymerizing 1-(2,5-dichlorophenyl)-3-methacrylamido-2-pyrazoline-5-one (Monomeric Coupler (M-13)) and n-butylacrylate A solution containing 2 g of sodium oleyl methyl tauride dissolved in 2 liters of water was slowly heated up to 95° C. with stirring in a stream of nitrogen and 40 ml of an aqueous solution containing 280 mg of potassium persulfate was added thereto. Next, 20 g of n-butylacrylate and 20 g of Monomeric Coupler (M-13) were dissolved in 400 ml of ethanol while heating and added to the above-described solution for about 30 minutes as crystals were prevented from separating out.

After the conclusion of the addition, the mixture was kept at 85° to 95° C. for 45 minutes with stirring. Thereafter, a 40 ml aqueous solution containing 120 mg of potassium persulfate was further added and the reaction proceeded for a further 1 hour. Then, ethanol and unreacted n-butylacrylate were distilled out as a water azeotrope.

The thus formed latex was cooled and adjusted to pH 6.0 using 1N sodium hydroxide, followed by filtration. The polymer concentration in the latex was 10.51%, and the nitrogen content, determined by elemental analysis, revealed that the copolymer formed contained 47.6% of Monomeric Coupler (M-13).

SYNTHESIS EXAMPLE 12

Polymer coupler latex (Latex Coupler (B)) obtained by copolymerizing 1-(2,5-dichlorophenyl)-3-methacryloylamino-2-pyrazoline-5-one (M-13) and n-butylacrylate 270 ml of an aqueous solution containing 1.54 g of sodium oleyl methyl tauride was slowly heated to 95° C. with stirring in a stream of nitrogen and 20 ml of an aqueous solution containing 28 mg of potassium persulfate and 2.8 g of n-butylacrylate were added thereto in this order. The resulting mixture was heated at 85° to 95° C. for about 1 hour with stirring in order to polymerize the same. Thus, Latex (a) was obtained. Next, to Latex (a) were added 14 g of Monomeric Coupler (M-13), 100 ml of methanol and further 10 ml of a methanol solution containing 14 g of n-butylacrylate. Subsequently, 50 ml of an aqueous solution containing 196 mg of potassium persulfate was added to the resulting mixture, and polymerization proceeded again by heating with stirring. After 1 hour, 30 ml of an aqueous solution containing 84 mg of potassium persulfate was further added, and the reaction proceeded for one and one half hours at the same temperature. Thereafter, methanol and unreacted n-butylacrylate were distilled out as a water azeotrope.

The thus formed latex was cooled and adjusted to pH 6.0 by 1N sodium hydroxide, and further subjected to filtration. The polymer concentration in the latex was 10.2%, and the nitrogen content, determined by elemental analysis, indicated that the copolymer formed contained 43.5% of Monomeric Coupler (M-13).

SYNTHESIS EXAMPLE 13

Polymer coupler latex (Latex Coupler (C)) obtained by copolymerizing 1-(2,5-dichlorophenyl)-3-methacryloylamino-2-pyrazoline-5-one (M-13) and n-butylacrylate A solution containing 240 mg of sodium oleyl methyl tauride dissolved in 20 ml of water was slowly heated to 95° C. with stirring in a stream of nitrogen and a hot solution containing 10 g of Monomeric Coupler (M-13) dissolved in 60 g of n-butylacrylate at 140° C. was added thereto for about 30 seconds as separation of crystals was prevented from occurring.

After the conclusion of the addition, the reaction mixture was further kept at 90°–95° C. for 45 minutes with stirring. Thereafter, 10 ml of an aqueous solution containing 120 mg of potassium persulfate was further added, and the reaction proceeded for an additional 1 hour at 90°–95° C. Then, unreacted n-butylacrylate was distilled out as a water azeotrope.

The thus formed latex was cooled and filtered. The polymer concentration in the latex was 26.4%, and the nitrogen content, determined by elemental analysis, indicated that the copolymer formed contained 18.5% of Monomeric Coupler (M-13).

SYNTHESIS EXAMPLE 14

Polymer coupler latex (Latex Coupler (D)) obtained by copolymerizing 1-(2,5-dichlorophenyl)-3-methacryloylamino-2-pyrazoline-5-one (M-13) and ethylacrylate 270 ml of an aqueous solution containing 1.54 g of sodium oleyl methyl tauride was slowly heated to 95° C. with stirring in a stream of nitrogen and 20 ml of an aqueous solution containing 28 mg of potassium persulfate was firstly added thereto and then 2.8 g of ethylacrylate was added thereto. The resulting mixture was kept at 85° to 95° C. for about 1 hour with stirring in order to polymerize the same. Thus, Latex (b) was obtained. Next, to Latex (b) were added 14 g of Monomeric Coupler (M-13), 100 ml of ethanol and further 10 ml of an ethanol solution containing 14 g of ethylacrylate. Subsequently, to the resulting mixture was added 50 ml of an aqueous solution containing 196 mg of potassium persulfate and the system heated so as to keep the temperature of the reaction system at 85°–95° C. with stirring. After polymerization was allowed to continue for 1 hour, 30 ml of an aqueous solution containing 84 mg of potassium persulfate was further added and the polymerization reaction proceeded for a further one and one half hour at 85°–95° C. Thereafter, ethanol and unreacted ethylacrylate were distilled out as a water azeotrope.

The thus formed latex was cooled and adjusted to pH 6.0 by 1N sodium hydroxide and further subjected to filtration. The polymer concentration in the latex was 10.3%, and the nitrogen content, determined by elemental analysis, indicated that the copolymer formed contained 43.7% of Monomeric Coupler (M-13).

SYNTHESIS EXAMPLE 15

Polymer coupler latex (Latex Coupler (E)) obtained by copolymerizing 1-(2,5-dichlorophenyl)-3-(2'-acryloylaminopropionoylamino)-2-pyrazoline-5-one (M-28) and n-hexylacrylate 270 ml of an aqueous solution containing 1.54 g of sodium oleyl methyl tauride was slowly heated to 95° C. with stirring in a stream of nitrogen and 20 ml of an aqueous solution containing 28 mg of potassium persulfate and 2.8 g of n-hexylacrylate were added thereto in that order. The resulting mixture was heated at 85° to 90° C. for about 1 hour with stirring in order to polymerize. Thus, Latex (c) was obtained.

Next, to Latex (c) were added 14 g of Monomeric Coupler (M-28), 100 ml of ethanol and further 10 ml of an ethanol solution containing 14 g of n-hexylacrylate. Subsequently, 50 ml of an aqueous solution containing 196 mg of potassium persulfate was added to the resulting mixture, and polymerization proceeded by heating and stirring. After 1 hour, 30 ml of an aqueous solution containing 84 mg of potassium persulfate was further added and the polymerization reaction proceeded again for an additional one and one half hours. Thereafter, ethanol and unreacted n-hexylacrylate were distilled out as a water azeotrope.

The thus formed latex was cooled and adjusted to pH 6.0 by 1N sodium hydroxide and further subjected to filtration. The polymer concentration in the latex was 10.3%, and the nitrogen content, determined by elemental analysis, indicated that the copolymer formed contained 45.7% of Monomeric Coupler (M-28).

SYNTHESIS EXAMPLE 16

Polymer coupler latex (Latex Coupler (F)) obtained by copolymerizing 1-(2,4,6-trichlorophenyl)-3-(3-methacrylamidobenzamido)-4-pyrazolyl-5-oxo-2-pyrazoline (Monomeric Coupler (M-29)) and n-butylacrylate 600 ml of an aqueous (distilled water) solution containing 1.25 g of sodium oleyl methyl tauride was slowly heated to 95° C. with stirring in a stream of nitrogen and 5 ml of an aqueous solution containing 175 mg of potassium persulfate added thereto.

Then, 20 g of n-butylacrylate and 5 g of Monomeric Coupler (M-29) were dissolved in 200 ml of an ethanol-acetonitrile mixed solvent while heating and added to the above-described mixture for about 30 seconds as separation of crystals was prevented from occurring.

After the conclusion of the addition, the reaction mixture was further kept at 85° to 95° C. for 45 minutes with stirring. Thereafter, 3 ml of an aqueous solution containing 75 mg of potassium persulfate was added, and the polymerization proceeded for an additional 1 hour at 85° to 95° C. Then, unreacted n-butylacrylate was distilled out as a water azeotrope.

The thus formed latex was cooled, adjusted to pH 6.0 by 1N sodium hydroxide and then subjected to filtration. The polymer concentration in the latex was 13.7%, and the nitrogen content, determined by elemental analysis, indicated that the copolymer formed contained 18.4% of Monomeric Coupler (M-29).

SYNTHESIS EXAMPLE 17

Polymer coupler latex (Latex Coupler (G)) obtained by copolymerizing 1-(2,4,6-trichlorophenyl)-3-methacrylamido-4-pyrazolyl-5-oxo-2-pyrazoline (Monomeric Coupler (M-30)) and n-butylacrylate 600 ml of an aqueous (distilled water) solution containing 1.25 g of sodium oleyl methyl tauride was slowly heated to 95° C. with stirring in a stream of nitrogen and 5 ml of an aqueous solution containing 280 mg of potassium persulfate added thereto.

Then, 20 g of n-butylacrylate and 20 g of Monomeric Coupler (M-30) were dissolved in 200 ml of ethanol while heating and added to the above-described mixture for about 30 seconds as separation of crystals was prevented from occurring.

After the conclusion of the addition, the reaction mixture was further kept at 85° to 95° C. for 45 minutes with stirring. Thereafter, 3 ml of an aqueous solution containing 120 mg of potassium persulfate was added, and the polymerization reaction proceeded for an additional 1 hour at 85° to 95° C. Then, unreacted n-butylacrylate was distilled out as a water azeotrope.

The thus formed latex was cooled, adjusted to pH 6.0 by 1N sodium hydroxide and then subjected to filtration. The polymer concentration in the latex was 9.9%, and the nitrogen content, determined by elemental analysis, indicated that the copolymer formed contained 48.9% of Monomeric Coupler (M-30).

SYNTHESIS EXAMPLE 18

Polymer coupler latex (Latex Couplder (H)) obtained by copolymerizing α-(4-methoxybenzoyl)-α-(1-benzyl-2,4-dioxo-5-ethoxyhydantoin-3-yl)-2-chloro-5-acrylamidoacetanilide (Y-11), n-butylacrylate and styrene 400 ml of an aqueous solution containing 2.2 g of oleyl methyl tauride was placed in a 1 liter flask and heated to 80° C. with stirring as a stream of nitrogen was passed through the flask. Then, 2 ml of a 2% aqueous solution of potassium persulfate and 4 g of styrene were added thereto.

After 1 hour, 20 g of Monomeric Coupler (Y-11), 20 g of butylacrylate and 200 ml of ethanol were added to the above-described reaction system and, subsequently, 14 ml of a 2% aqueous solution of potassium persulfate was added thereto. One hour later, 6 ml of the potassium persulfate solution was further added to the reaction system. After the polymerization reaction proceeded for an additional 1 hour (all reaction being at 80° C.), unreacted monomeric coupler and ethanol were distilled out.

The thus formed latex was cooled, filtered and adjusted to pH 6.0 by 1N sodium hydroxide.

The polymer concentration in the latex was 10.3%, and the nitrogen content, determined by elemental analysis, indicated that 45.7% of Monomeric Coupler (Y-11) was contained in the copolymer formed.

SYNTHESIS EXAMPLE 19

Polymer coupler latex (Latex Coupler (I)) obtained by copolymerizing α-(4-methoxybenzoyl)-α-(1-pyrazolyl)-2-chloro-5-methacryloylaminoacetanilide (Y-7), n-butylacrylate and ethylacrylate 400 ml of an aqueous solution containing 5.5 g of sodium oleyl methyl tauride was placed in a 1 liter flask and heated to 80° C. with stirring as a stream of nitrogen was passed through the flask. Thereto, 1.5 ml of a 10% aqueous solution of sodium salt of 4,4'-azobis(4-cyanovalerianic acid) and 15 g of ethylacrylate were added.

After 1 hour, 20 g of Monomeric Coupler (Y-7), 80 g of n-butylacrylate and 150 ml of ethanol were added to the above-described reaction system and, subsequently, 7 ml of a 10% aqueous solution of the sodium salt of 4,4'-azobis(4-cyanovalerianic acid) was added thereto. One hour later, 3 ml of the potassium persulfate solution was further added. After the polymerization reaction proceeded for an additional 1 hour (all reactions at 80° C.), unreacted monomeric coupler and ethanol were distilled out.

The thus formed latex was cooled, filtered, and adjusted to pH 6.0 by 1N sodium hydroxide.

The polymer concentration in the latex was 29.5%, and the nitrogen content, determined by elemental analysis, indicated that 17.2% of Monomeric Coupler (Y-7) was contained in the copolymer formed.

SYNTHESIS EXAMPLE 20

Polymer coupler (Oleophilic Polymer Coupler (I)) obtained by copolymerizing 1-(2,4,6-trichlorophenyl)-3-(3-methacrylamidobenzamido)-4-pyrazolyl-5-oxo-2-pyrazoline (Monomeric Coupler (M-29)) and n-butylacrylate To 150 ml of dioxane were added 20 g of Monomeric Coupler (M-29) and 20 g of n-butylacrylate and the system heated to 85° C. under an atmosphere of nitrogen gas. Then, 350 mg of 2,2'-azobis(2,4-dimethylvaleronitrile) dissolved in 10 ml of dioxane was added to the resulting solution with stirring. The heating was continued for about 3 hours so as to maintain the reaction temperature at 85° C. Thereafter, the reaction temperature was raised up to 95° C. and the heating was continued for a further 2 hours. Next, the resulting reaction mixture was cooled to room temperature, poured into 2 liters of ice water to precipitate a solid which was filtered off and washed with water thoroughly.

The thus obtained solid was dried by heating under reduced pressure to produce 39.4 g of Oleophilic Polymer Coupler (I). The nitrogen content, found by elemental analysis, indicated that 48.2% of Monomeric Coupler (M-29) was contained in the oleophilic copolymer coupler formed.

Next, Oleophilic Polymer Coupler (I) was emulsified and dispersed in the form of a latex into a gelatin aqueous solution in the following manner:

To begin with, two kinds of Solutions (a) and (b) were prepared as follows.

(a) 300 g of a 5.0 wt% aqueous solution of bone gelatin (pH value: 5.6 at 35° C.) was warmed up to 32° C. and 12 ml of a 10 wt% aqueous solution of sodium laurylsulfate added thereto.

(b) 30 g of Oleophilic Polymer Coupler (I) was dissolved in 60 g of ethyl acetate at 38° C.

Then, Solution (b) was placed in a mixer equipped with an explosion preventing device and agitated at high speed. Solution (a) was added rapidly thereto. After 1 minute's agitation, the mixer was stopped. Then, ethyl acetate was removed from the mixture by vacuum distillation. Thus, Latex (I'), wherein the oleophilic polymer coupler was emulsified and dispersed in a dilute gelatin solution, was obtained.

SYNTHESIS EXAMPLE 21

Polymer coupler (Oleophilic Polymer Coupler (II)) obtained by copolymerizing 1-(2,4,6-trichlorophenyl)-3-methacrylamido-4-pyrazolyl-5-oxo-2-pyrazoline (Monomeric Coupler (M-30)) and n-butylacrylate To 150 ml of dioxane were added 20 g of Monomeric Coupler (M-30) and 20 g of n-butylacrylate and the system heated up to 85° C. under an atmosphere of nitrogen gas to dissolve the components. To the resulting solution was added 400 mg of azobisisobutyronitrile dissolved in 10 ml of dioxane to initiate the copolymerization reaction. After 1 hour, 400 mg of azobisisobutyronitrile dissolved in 10 ml of dioxane was further added. After continued heating under reflux for about an additional 3 hours, the reaction temperature was raised up to 95° C. and the heating was continued at 95° C. for an additional 2 hours.

Next, the resulting reaction mixture was cooled to room temperature, poured into 2 liters of ice water to precipitate a solid which was filtered off and thoroughly washed with water. The thus obtained solid was dissolved in ethyl acetate and reprecipitated therefrom by addition of n-hexane. The precipitate was dried by heating under reduced pressure to obtain 37.87 g of Oleophilic Polymer Coupler (II). The nitrogen content, found by elemental analysis, of Oleophilic Polymer Coupler (II) indicated that 49.2% of Monomeric Coupler (M-30) was contained in the copolymer formed.

Oleophilic Polymer Coupler (II) was emulsified and dispersed in the form of a latex into a gelatin aqueous solution in the following manner.

Two kinds of Solutions (a) and (b) were prepared.

(a) 200 g of a 3.0 wt% aqueous solution of bone gelatin (pH value: 5.6 at 35° C.) was warmed up to 38° C. and 16 ml of a 10.0 wt% aqueous solution of sodium laurylsulfate was added thereto.

(b) 20 g of Oleophilic Polymer Coupler (II) was dissolved in 200 ml of ethyl acetate at 38° C.

Then, Solution (b) was placed in a mixer equipped with an explosion preventing device and agitated at a high speed. Solution (a) was added rapidly thereto. After 1 minute's agitation the mixer was stopped. Then, ethyl acetate was removed from the mixture by vacuum distillation. Thus, Latex (II'), wherein the oleophilic polymer coupler was emulsified and dispersed in a dilute gelatin solution, was obtained.

SYNTHESIS EXAMPLE 22

Polymer coupler (Oleophilic Polymer Coupler (III)) obtained by copolymerizing 1-(2,5-dichlorophenyl)-3-methacryloylamino-2-pyrazolyl-5-one (Monomeric Coupler (M-13)) and n-butylacrylate A mixture containing 20 g of Monomeric Coupler (M-13), 20 g of n-butylacrylate and 150 ml of dioxane was heated up to 60° C. with stirring and there was added thereto 350 mg of azobisisobutyronitrile dissolved in 10 ml of dioxane. The heating was continued for about 5 hours at 60° C. and then the reaction temperature was raised to 90° C. The heating was further continued at 90° C. for an additional 2 hours. Next, the resulting reaction mixture was poured into 2 liters of ice water to precipitate a solid which was filtered off and washed with water thoroughly. The precipitate was dried by heating under reduced pressure to obtain 38.4 g of Oleophilic Polymer Coupler (III). The nitrogen content, found by elemental analysis, of this polymer coupler indicated that 52.3% of Monomeric Coupler (M-13) was contained in the copolymer formed.

The thus obtained Oleophilic Coupler (III) was dispersed in the form of a latex into a gelatin aqueous solution in the following manner:

Two kinds of Solutions (a) and (b) were prepared.

(a) 300 g of a 5 wt% aqueous solution of bone gelatin (pH value: 5.6 at 35° C.) was warmed up to 32° C. and 12 ml of a 10 wt% aqueous solution of sodium laurylsulfate was added thereto.

(b) 20 g of Oleophilic Polymer Coupler (III) was dissolved in 60 g of ethyl acetate.

Then, Solution (b) was placed in a mixer equipped with an explosion preventing device and agitated at high speed. Solution (a) was added rapidly thereto. After 1 minute's agitation the mixer was stopped. Ethyl acetate was then removed from the mixture by vacuum distillation. Thus, Latex (III'), wherein the oleophilic polymer coupler was dispersed in a dilute gelatin solution, was obtained.

SYNTHESIS EXAMPLE 23

Polymer coupler (Oleophilic Polymer Coupler (IV)) obtained by copolymerizing 1-(2,5-dichlorophenyl)-3-methacryloylamino-2-pyrazoline-5-one (Monomeric Coupler (M-13)), methylmethacrylate and n-butylacrylate A mixture containing 20 g of Monomeric Coupler (M-13), 10 g of methylmethacrylate, 10 g of n-butylacrylate and 150 ml of dioxane was heated with stirring under reflux and there was added thereto 350 mg of azobisisobutyronitrile dissolved in 10 ml of dioxane. The heating was continued under reflux for about 3 hours.

Then, the reaction mixture was poured into 2 liters of ice water to precipitate a solid which was filtered off and washed with water thoroughly. The precipitate taken out was dissolved again in ethyl acetate and reprecipitated therefrom by n-hexane. The thus obtained precipitate was dried by heating under reduced pressure to yield 35.2 g of Oleophilic Polymer Coupler (IV). The nitrogen content, found by elemental analysis, of the polymer coupler indicated that 51.3% of Monomeric Coupler (M-13) was contained in the copolymer formed.

Next, the Oleophilic Polymer Coupler (IV) was emulsified and dispersed in the form of a latex into an aqueous solution of gelatin in the following manner:

Two kinds of Solutions (a) and (b) were prepared.

(a) 200 g of a 3.0 wt% aqueous solution of bone gelatin (pH: 5.6 at 35° C.) was warmed up to 38° C. and 16 ml of a 10 wt% aqueous solution of sodium laurylsulfate was added thereto.

(b) 20 g of the above-described Oleophilic Polymer Coupler (IV) was dissolved in 200 ml of ethyl acetate at 38° C.

Solution (b) was placed in a mixer equipped with an explosion preventing device and agitated at high speed. Solution (a) was added rapidly thereto. After 1 minute's agitation, the mixer was stopped. Then, ethyl acetate was removed from the mixture by vacuum distillation. Thus, Latex (IV'), wherein the oleophilic polymer coupler was dispersed in a dilute gelatin solution, was obtained.

SYNTHESIS EXAMPLES 24 TO 40

Copolymer coupler latexes set forth in the following table were prepared using monomeric couplers illustrated hereinbefore according to Synthesis Examples 11, 16 and 17.

| | | Polymer Coupler Latexes | | | | |
|---|---|---|---|---|---|---|
| | | Monomeric Coupler | | Comonomer | | |
| Synthesis Example | Polymer Coupler Latex | Kind | Amount (g) | Kind | Amount (g) | Fraction of Monomeric Coupler in Copolymer (wt %) |
| 24 | (J) | (C-5) | 10 | BA | 40 | 19.7 |
| 25 | (K) | (C-8) | 10 | MA | 10 | 51.2 |
| | | | | MAA | 2 | |
| 26 | (L) | (C-8) | 10 | MA | 10 | 47.7 |
| 27 | (M) | (C-10) | 10 | PA | 40 | 18.9 |
| 28 | (N) | (M-4) | 10 | EA | 10 | 50.3 |
| 29 | (O) | (M-9) | 10 | OA | 20 | 32.5 |
| 30 | (P) | (M-10) | 5 | BA | 10 | 50.1 |
| | | (M-13) | 5 | | | |
| 31 | (Q) | (M-14) | 10 | BA | 10 | 51.2 |
| 32 | (R) | (M-15) | 10 | BA | 20 | 32.9 |
| 33 | (S) | (M-25) | 10 | BA | 10 | 50.6 |
| | | | | MA | 10 | |
| 34 | (T) | (M-26) | 10 | EHA | 10 | 49.8 |
| 35 | (U) | (M-28) | 10 | BA | 10 | 49.4 |
| 36 | (V) | (M-30) | 10 | MA | 40 | 19.5 |
| 37 | (W) | (Y-5) | 10 | BA | 40 | 19.6 |
| 38 | (X) | (Y-6) | 10 | PA | 40 | 18.9 |
| 39 | (Y) | (Y-8) | 10 | iBA | 40 | 19.5 |
| 40 | (Z) | (Y-11) | 10 | HA | 40 | 19.7 |

SYNTHESIS EXAMPLES 41 TO 57

Copolymer coupler latexes having a layer structure as set forth in the following table were prepared using monomeric couplers illustrated hereinbefore according to Synthesis Examples 12, 14, 15, 18 and 19 which correspond to the method described in Japanese Patent Application No. 140667/81.

| Synthesis Example | Layer Structure Polymer Coupler Latex | Layer Structure Polymer Coupler Latexes: Seeded Monomer Kind | Seeded Monomer Amount (g) | After-Added Monomer Kind | After-Added Monomer Amount (g) | After-Added Monomer Kind | After-Added Monomer Amount (g) | Fraction of Monomeric Coupler in Copolymer (wt %) |
|---|---|---|---|---|---|---|---|---|
| 41 | (AA) | EA | 4 | (M-13) | 20 | EA | 20 | 49.5 |
| 42 | (AB) | BA | 5 | (M-22) | 20 | BA | 80 | 18.3 |
| 43 | (AC) | St | 4 | (M-10) | 20 | BA | 20 | 45.2 |
| 44 | (AD) | BA | 10 | (C-2) | 20 | BA | 80 | 18.0 |
| 45 | (AE) | St | 4 | (C-8) | 20 | EHA | 40 | 30.8 |
| 46 | (AF) | MMA | 5 | (C-9) | 20 | EA | 20 | 41.3 |
| 47 | (AG) | BA | 2 | (M-1) | 20 | BA | 20 | 45.5 |
| 48 | (AH) | BA | 3 | (M-3) | 10 | EA | 10 | 42.8 |
| 49 | (AI) | MA | 3 | (M-9) | 10 | MA | 40 | 18.3 |
| 50 | (AJ) | BMA | 4 | (M-15) | 10 | BA | 40 | 17.5 |
| 51 | (AK) | MMA | 3 | (M-16) | 10 | BA | 20 | 28.4 |
| 52 | (AL) | St | 5 | (M-18) | 10 | EA | 40 | 17.6 |
| 53 | (AM) | BA | 9 | (M-19) | 30 | EHA | 15 | 55.6 |
| 54 | (AN) | BA | 5 | (M-25) | 10 | BA | 10 | 42.7 |
| 55 | (AO) | EA | 5 | (Y-1) | 10 | EHA | 40 | 17.3 |
| 56 | (AP) | BA | 10 | (Y-4) | 20 | BA | 80 | 17.9 |
| 57 | (AQ) | St | 5 | (Y-6) | 20 | BA | 20 | 40.8 |
| | | | | | | MAA | 2 | |

SYNTHESIS EXAMPLES 58 TO 77

Oleophilic polymer couplers set forth in the following table were synthesized using monomeric couplers illustrated hereinbefore according to Synthesis Examples 20, 21, 22 and 23.

| Synthesis Example | Oleophilic Polymer Coupler | Oleophilic Polymer Coupler: Monomer Coupler Kind | Monomer Coupler Amount (g) | Comonomer Kind | Comonomer Amount (g) | Fraction of Monomeric Coupler in Copolymer (wt %) |
|---|---|---|---|---|---|---|
| 58 | (V) | (C-5) | 10 | MA | 10 | 51.3 |
| 59 | (VI) | (C-8) | 10 | MA | 10 | 52.1 |
| 60 | (VII) | (C-8) | 10 | MA | 10 | 49.7 |
| | | | | MAA | 2 | |
| 61 | (VIII) | (C-8) | 10 | MA | 10 | 47.5 |
| | | | | DAAM | 3 | |
| 62 | (IX) | (C-12) | 10 | BA | 40 | 19.3 |
| 63 | (X) | (C-14) | 10 | BA | 20 | 30.5 |
| 64 | (XI) | (C-15) | 10 | MA | 10 | 51.4 |
| 65 | (XII) | (C-15) | 10 | MA | 10 | 48.3 |
| | | | | DAAM | 2 | |
| 66 | (XIII) | (C-16) | 10 | MA | 10 | 53.1 |
| 67 | (XIV) | (M-4) | 10 | BA | 10 | 52.9 |
| 68 | (XV) | (M-13) | 22.5 | BA | 27.5 | 44.5 |
| 69 | (XVI) | (M-14) | 10 | iBA | 10 | 50.1 |
| 70 | (XVI) | (M-15) | 10 | BA | 30 | 25.0 |
| 71 | (XVII) | (M-16) | 10 | MA | 40 | 23.5 |
| 72 | (XVIII) | (M-13) | 5 | BA | 10 | 50.6 |
| | | (M-23) | 5 | | | |
| 73 | (XIX) | (M-28) | 10 | OA | 10 | 47.9 |
| 74 | (XX) | (Y-1) | 10 | BA | 40 | 19.5 |
| 75 | (XXI) | (Y-5) | 10 | BA | 40 | 19.4 |
| 76 | (XXII) | (Y-9) | 10 | BA | 40 | 19.7 |
| 77 | (XXIII) | (Y-11) | 10 | BA | 40 | 19.2 |

Each of these oleophilic polymer couplers can be emulsified and dispersed in the form of a latex in a gelatin aqueous solution according to Synthesis Examples 20, 21, 22 and 23.

In the above-described tables, all amounts of monomeric couplers and those of comonomers are amounts charged (by weight).

Abbreviations used mean the following monomers:

MA: Methylacrylate
EA: Ethylacrylate
PA: n-Propylacrylate
BA: n-Butylacrylate
iBA: i-Butylacrylate
HA: n-Hexylacrylate
OA: n-Octylacrylate
EHA: 2-Ethylhexylacrylate
MMA: Methylmethacrylate
BMA: n-Butylmethacrylate
St: Styrene
MAA: Methacrylic Acid
DAAM: Diacetoneacrylamide As described above, the objects of the present invention can be attained with a color sensitive material wherein diffusible DIR couplers and polymer couplers are incorporated in combination in a color sensitive material. In particular, it is desirable to incorporate both the diffusible DIR coupler and the polymer coupler in the same layer of a color sensitive material from the standpoint of making the diffusible DIR coupler exhibit its edge effect to the fullest.

Good results are obtained when the polymer coupler latex is added in the range of 0.005 to 0.5 mol, particularly 0.01 to 0.05 mol, per mol of silver based on the monomeric coupler.

On the other hand, it is advantageous to add the diffusible DIR coupler in an amount of 0.0001 to 0.5 mol, preferably 0.001 to 0.05 mol, per mol of silver.

In the light-sensitive materials of the present invention, the high boiling point organic solvents exemplified below can be incorporated. Specific examples thereof include alkyl esters of phthalic acid (e.g., dibutyl phthalate, dioctyl phthalate, etc.), phosphoric acid esters (e.g., diphenyl phosphate, triphenyl phosphate, tricresyl phosphate, dioctyl butyl phosphate, etc.), citric acid esters (e.g., tributyl acetylcitrate, etc.), benzoic acid esters (e.g., octyl benzoate), alkylamides (e.g., diethyllaurylamide), fatty acid esters (e.g., dibutoxyethylsuccinate, dioctyl azelate, etc.), trimesic acid esters (e.g., tributyl trimesate) and so on.

Detailed disclosure of useful high boiling point solvents are found in, e.g., U.S. Pat. Nos. 2,322,027, 2,533,514 and 2,835,579, Japanese Patent Publication No. 23233/71, U.S. Pat. No. 3,287,134, British Pat. No. 958,441, Japanese Patent Application (OPI) No. 1031/72, British Pat. No. 1,222,753, U.S. Pat. No. 3,936,303, Japanese Patent Application (OPI) Nos. 26037/76 and 82078/75, U.S. Pat. Nos. 2,353,262, 2,852,383, 3,554,755, 3,676,137, 3,676,142, 3,700,454, 3,748,141 and 3,837,863, West German Patent Application (OLS) No. 2,538,889, Japanese Patent Application (OPI) Nos. 27921/76, 27922/76, 26035/76, 26036/76 and 62632/75, Japanese Patent Publication No. 29461/74, U.S. Pat. No. 3,936,303 and 3,748,141, Japanese Patent Application (OPI) No. 1521/78, and so on.

In the case that a polymer coupler is used, the high boiling point solvent may be added in an amount of 0.5 g at the most, preferably 0.3 g or less, per 1 g of polymer coupler latex.

Binders or protective colloids which can be used to advantage in preparing photographic emulsions include conventional gelatins. However, other conventional hydrophilic colloids can be also used herein.

Examples of suitable hydrophilic colloids include proteins such as gelatin derivatives, graft polymers obtained by grafting other high polymers onto gelatin, albumin, casein, etc.; cellulose derivatives such as hydroxyethyl cellulose, carboxymethyl cellulose, cellulose sulfates and the like; sugar derivatives such as sodium alginate, starch derivatives, etc.; and synthetic hydrophilic high molecular weight polymers such as polyvinyl alcohol, partially acetylated polyvinyl alcohol, poly-N-vinylpyrrolidone, polyacrylic acid, polymethacrylic acid, polyacrylamide, polyvinylimidazole, polyvinylpyrazole, copolymers containing repeating units which constitute the above-described polymers, and so on.

Examples of the gelatins which can be used are not only lime-processed gelatin, but also acid-processed gelatin, enzyme-processed gelatin as described in *Bull. Soc. Sci. Phot. Japan,* No. 16, p. 30 (1966) and, furtherhydrolysis products and enzymatically decomposed products of gelatins.

Gelatin derivatives which can be used include those obtained by reacting gelatin with various kinds of compounds such as acid halides, acid anhydrides, isocyanates, bromoacetic acid, alkane sulfones, vinylsulfonamides, maleinimide compounds, polyalkylene oxides, epoxy compounds and so on. Specific examples thereof are disclosed in U.S. Pat. Nos. 2,614,928, 3,132,945, 3,186,846 and 3,312,553, British Pat. Nos. 861,414, 1,033,189 and 1,005,784, Japanese Patent Publication No. 26845/67, and so on.

Grafted gelatins which can be used include gelatins modified by graft-copolymerizing gelatins with acrylic acid, methacrylic acid, esters thereof, amides thereof, acrylonitrile, styrene or/and other vinyl monomers. Among them, gelatins on which polymers having some degree of compatibility with gelatins, such as acrylic acid polymers, methacrylic acid polymers, acrylamide polymers, methacrylamide polymers, hydroxyalkylmethacrylate polymers and the like, are grafted are used to greater advantage.

Typical examples of synthetic hydrophilic high polymers which can be used are those described in West German Patent Application (OLS) No. 2,312,708, U.S. Pat. Nos. 3,620,751 and 3,879,205, and Japanese Patent Publication No. 7561/68.

Silver halides which can be present in photographic emulsion layers of photographic materials employed in the present invention are conventional and include silver bromide, silver iodobromide, silver iodochlorobromide, silver chlorobromide and silver chloride. Preferable silver halides are silver iodobromides containing 15 mol% or less of iodide. Especially preferred ones are silver iodobromides containing 2 to 12 mol% of silver iodide.

Silver halide grains in the photographic emulsion may have any conventional mean grain size (the grain size being defined as grain diameter if the grain has a spherical or a nearly spherical form and as a length of the edge if the grain has a cubic form, and being averaged based on projected areas of the grains). However, very good results are obtained when the mean grain size is 3$\mu$ or less.

Grain size distribution may be either narrow or broad.

Silver halide grains in the photographic emulsion may have a regular crystal form such as that of a cube, an octahedron or so on, an irregular crystal form such as that of a sphere, a plate or so on, or a composite form thereof. Also, silver halide grains may be a mixture of grains having various kinds of crystal forms.

The individual silver halide grains may comprise a core and an outer shell or may be homogeneous. In addition, they may have a surface where a latent image has been formed to an appreciable extent, or may be grains where a latent image is predominantly formed in the interior thereof.

Photographic emulsions employed in the present invention can be prepared using conventional methods as described in P. Glafkides, *Chimie et Physique Photographique,* Paul Montel, Paris (1967), G. F. Duffin, *Photographic Emulsion Chemistry,* The Focal Press, London (1966), V. L. Zelikman, et al., *Making and Coating Photographic Emulsion,* The Focal Press, London (1964), and so on. That is, photographic emulsions can be prepared using the acid process, the neutral process, the ammonia process, or so on. Suitable methods for reacting a water-soluble silver salt with a water-soluble halide include a single jet method, a double jet method, a combination thereof, and so on.

Also, a method in which silver halide grains are produced in the presence of excess silver ions (the so-called reverse mixing method) can be employed. Further, the so-called controlled double jet method, in which the pAg of the liquid phase wherein silver halide grains are to be precipitated is maintained constant, may be employed.

According to this method, silver halide emulsions in which grains have a regular crystal form and almost uniform size can be obtained.

Two or more silver halide emulsions prepared separately may also be employed in the form of mixture.

In a process of producing silver halide grains or allowing the produced silver halide grains to ripen physically, cadmium salts, zinc salts, lead salts, thallium salts, iridium salts or complexes, rhodium salts or complexes, iron salts or complexes and/or the like may be present.

Removal of the soluble salts from the silver halide emulsion after the formation of silver halide grains or after physical ripening can be effected using the noodle washing method (which comprises gelling the gelatin), or using a sedimentation process (thereby causing flocculation in the emulsion) using an inorganic salt, an anionic surface active agent, an anionic polymer (e.g., polystyrenesulfonic acid), or a gelatin derivative (e.g., acylated gelatin, carbamoylated gelatin, etc.).

It is usual for the silver halide emulsion to be chemically sensitized. Chemical sensitization can be carried out using processes as described in, e.g., H. Frieser, *Die Grundlagen der Photographischen Prozesse mit Silberhalogeniden,* pp. 675–734, Akademische Verlagsgesellschaft (1968).

More specifically, sulfur sensitization using compounds containing sulfur capable of reacting with active gelatin or silver ions (e.g., thiosulfates, thioureas, mercapto compounds, rhodanines, etc.), reduction sensitization using reducing materials (e.g., stannous salts, amines, hydrazine derivatives, formamidinesulfonic acid, silane compounds, etc.), sensitization with noble metal compounds (e.g., gold complexes, and complexes of Group VIII metals such as Pt, Ir, Pd, etc.) and so on can be employed individually or as a combination thereof.

Specific examples of sulfur sensitization are described in U.S. Pat. Nos. 1,574,944, 2,410,689, 2,278,947, 2,728,668 and 3,656,955, and so on. Specific examples of reduction sensitization are described in U.S. Pat. Nos. 2,983,609, 2,419,974 and 4,054,458, and so on. Specific examples of noble metal sensitization are described in U.S. Pat. Nos. 2,399,083 and 2,448,060, British Pat. No. 618,061, and so on.

Photographic emulsions employed in the present invention can contain various conventional compounds for the purpose of preventing fog in preparation, storage or photographic processing, or for stabilizing photographic properties. Specific examples of such compounds include azoles such as benzothiazolium salts, nitroindazoles, triazoles, benzotriazoles and benzimidazoles (especially nitro- or halogen-substituted ones); heterocyclic mercapto compounds such as mercaptothiazoles, mercaptobenzothiazoles, mercaptobenzimidazoles, mercaptothiadiazoles, mercaptotetrazoles (especially 1-phenyl-5-mercaptotetrazole) and mercaptopyrimidines; the above-described heterocyclic mercapto compounds having water-soluble groups such as a carboxyl group, a sulfonyl group or the like; thioketo compounds such as oxazolinethione; azaindenes such as tetraazaindenes (especially 4-hydroxy-substituted (1,3,3a,7)tetraazaindenes); benzenethiosulfonic acids; benzenesulfinic acids; and other various compounds known as anti-foggants or stabilizers.

For details of specific examples and usages of such compounds disclosure is given in, e.g., U.S. Pat. Nos. 3,954,474, 3,982,947 and 4,021,248, or Japanese Patent Publication No. 28660/77 can be referred to.

Photographic emulsions or other hydrophilic colloidal layers of the light-sensitive materials of the present invention may contain various kinds of surface active agents for a wide variety of conventional purposes, for example, as a coating aid, prevention of static charges, improvement in a slipping property, emulsifying dispersions, prevention or adhesion, improvement in photographic characteristics (e.g., development acceleration, increase in contrast, sensitization, etc.), and so on.

Specific examples of surface active agents which can be used include nonionic surface active agents such as saponin (steroid type), alkylene oxide derivatives (e.g., polyethylene glycol, polyethylene glycol/polypropylene glycol condensates, polyethylene glycol alkyl ethers or polyethylene glycol alkyl aryl ethers, polyethylene glycol esters, polyethylene glycol sorbitol esters, polyalkylene glycol alkylamines or polyalkylene glycol alkylamides, polyethylene oxide adducts of silicone, etc.), glycidol derivatives (e.g., alkenylsuccinic polyglycerides, alkylphenyl polyglycerides, etc.), fatty acid esters of polyhydric alcohols, alkyl esters of sugars, and so on; anionic surface active agents containing acidic groups such as carboxyl, sulfo, phospho, sulfate, phosphate and like groups, e.g., alkylcarboxylates, alkylsulfonates, alkylbenzenesulfonates, alkylnaphthalenesulfonates, alkylsulfates, alkylphosphates, N-acyl-N-alkyltaurines, sulfosuccinates, sulfoalkylpolyoxyethylene alkyl phenyl ethers, polyoxyethylene alkylphosphates and so on; amphoteric surface active agents such as amino acids, aminoalkylsulfonic acids, aminoalkyl sulfates or phosphates, alkylbetaines, amine oxides, and so on; and cationic surface active agents such as alkylamine salts, aliphatic or aromatic quaternary ammonium salts, heterocyclic quaternary ammonium salts, e.g., pyridinium, imidazolium, etc., aliphatic or heterocyclic phosphonium or sulfonium salts, and so on.

The photographic emulsions of the present invention may contain, for example, polyalkylene oxides and derivatives thereof such as the ethers, esters and amines thereof, thioether compounds, thiomorpholines, quaternary ammonium salt compounds, urethane derivatives, urea derivatives, imidazole derivatives, 3-pyrazolidones and so on in order to increase the sensitivity and the contrast thereof, or in order to accelerate the developing rate thereof. Examples of such compounds are disclosed in, e.g., U.S. Pat. Nos. 2,400,532, 2,423,549, 2,716,062, 3,617,280, 3,772,021, 3,808,003, British Pat. No. 1,488,991, and so on.

The photographic emulsions or other hydrophilic colloidal layers of photographic materials used in the practice of the present invention can contain dispersions of water-insoluble or slightly soluble synthetic polymers for the purpose of improving dimensional stability and so on. Specific examples of such polymers include those having as monomer components alkyl(meth)acrylate, alkoxyalkyl(meth)acrylate, glycidyl(meth)acrylate, (meth)acrylamide, vinyl ester (e.g., vinyl acetate), acrylonitrile, olefin and styrene, individually or as combinations of two or more thereof, or a combination of one of the above-described monomers and acrylic acid, methacrylic acid, an α,β-unsaturated dicarboxylic acid, a hydroxyalkyl(meth)acrylate, a sulfoalkyl(meth)acrylate, styrenesulfonic acid, or so on. More specifically, such polymers are disclosed in U.S. Pat. Nos. 2,376,005, 2,739,137, 2,853,457, 3,062,674, 3,411,911, 3,488,708, 3,525,620 3,607,290, 3,635,715 and 3,645,740, British Pat. Nos. 1,186,699 and 1,307,373, and so on.

Conventional methods and processing solutions, as described in, e.g., *Research Disclosure,* No. 176, pp. 28–30 (RD-17643), can be applied to photographic processing of photographic emulsions prepared in acordance with the present invention. Any photographic processing, whether for the formation of dye images (for color photographic processings) or not can be used depending on the end use of the light-sensitive material. Processing temperatures are generally selected from the range of 18° C. to 50° C. However, temperatures lower than 18° C. and temperatures higher than 50° C. may also be used.

In development processing, a method where a developing agent is contained in the light-sensitive material, e.g., in an emulsion layer, and the sensitive material is treated in an aqueous alkaline solution to effect development may be employed. Developing agents which are hydrophobic can be incorporated in emulsion layers using various methods as described in, e.g., *Research Disclosure,* No. 169 (RD-16928), U.S. Pat. No. 2,739,890, British Pat. No. 813,253, West German Pat. No. 1,547,763, and so on. Such development processing may be carried out in combination with silver salt stabilizing processing using a thiocyanate.

A conventional fixing solution can be used. Examples of fixing agents which can be used include not only thiosulfates and thiocyanates, but also organic sulfur compounds which are known to have a fixing effect. The fixing solution may contain water-soluble aluminum salts as a hardener.

Dye images can be formed using conventional methods, for example, the negative-positive method (described in *Journal of the Society of Motion Picture and Television Engineers,* Vol. 61, pp. 667–701 (1953) and so on).

The color developing solution is conventional and generally comprises an alkaline aqueous solution containing a color developing agent. Specific examples of color developing agents include known aromatic primary amine developers such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.).

In addition to the above-described color developing agents, those described in L. F. A. Mason, *Photographic Processing Chemistry,* pp. 226–229, Focal Press, London (1966), U.S. Pat. Nos. 2,193,015 and 2,592,364, Japanese Patent Application (OPI) No. 64933/73, and so on may be employed as a color developing agent.

The color developing solution can additionally contain a pH buffer, a development restrainer and an antifoggant. Optionally, it may contain a water softener, a preservative, an organic solvent, a development accelerator, dye forming couplers, competing couplers, a fogging agent, an assistant developer, a viscosity imparting agent, a polycarboxylic acid series chelating agent, an antioxidant, and so on.

Specific examples of these additives are disclosed in *Research Disclosure* (RD-17643), U.S. Pat. No. 4,083,723, West German Patent Application (OLS) No. 2,622,950, and so on.

After color development, the photographic emulsion is generally subjected to a conventional bleaching. Bleaching may be carried out simultaneously with conventional fixing, or these two processes may be carried out separately. Examples of bleaching agents which can be used include compounds of polyvalent metals, such as Fe (III), Co (III), Cr (VI), Cu (II) and the like; peroxy acids, quinones, nitroso compounds and so on.

More specifically, bleaching agents which can be used include ferricyanides; bichromates; complex salts formed by Fe (III) or Co (III) and aminopolycarboxylic acids, such as ethylenediaminetetraacetic acid, nitrilotriacetate, 1,3-diamino-2-propanol tetraacetic acid, etc., or organic acids such as citric acid, tartaric acid, maleic acid, etc.; persulfates and permanganates; nitrosophenol; and so on. Among these agents, potassium ferricyanide, sodium (ethylenediaminetetraacetato)ferrate (III) and ammonium (ethylenediaminetetraacetato)ferrate (III) are especially useful. The (ethylenediaminetetraacetato)iron (III) complexes are useful in both an independent bleaching solution and a combined bleach-fix bath.

The bleaching or the bleach-fix bath can contain a bleach accelerating agent as described in U.S. Pat. Nos. 3,042,520 and 3,241,966, Japanese Patent Publication Nos. 8506/70 and 8836/70, and so on, thiol compounds described in Japanese Patent Application (OPI) No. 65732/78, and other various kinds of additives.

Photographic emulsions employed in the present invention may be spectrally sensitized with methine dyes and others.

Examples of useful sensitizing dyes are described in German Pat. No. 929,080, U.S. Pat. Nos. 2,493,748, 2,503,776, 2,519,001, 2,912,329, 3,656,959, 3,672,897 and 4,025,349, British Pat. No. 1,242,588, and Japanese Patent Publication No. 14030/69.

These sensitizing dyes may be employed in a conventional manner or as a combination of two or more thereof. Combinations of sensitizing dyes are frequently employed for the purpose of supersensitization. Typical examples of supersensitizing combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,814,609 and 4,026,707, British Pat. No. 1,344,281, Japanese Patent Publication Nos. 4936/68 and 12375/83, Japanese Patent Application (OPI) Nos. 110618/82 and 109925/82, so on.

In the photographic materials prepared in accordance with the present invention, photographic emulsion layers and other layers are coated on a conventional flexible support such as a plastic film, paper, cloth or the like, or a rigid support such as glass, ceramic, metal or the like. Examples of flexible support which can be used to advantage include films made from semi-synthetic or synthetic high molecular weight polymers such as cellulose nitrate, cellulose acetate, cellulose acetate butyrate, polystyrene, polyvinyl chloride, polyethylene terephthalate, polycarbonate, etc.; and paper coated or laminated with a baryta layer or an α-olefin polymer (e.g., polyethylene, polypropylene, an ethylene-butene copolymer, etc.).

Supports may be colored with dyes or pigments. Further, they may be rendered black for the purpose of shielding light. The surfaces of these supports are, in general, subjected to a subbing treatment to increase adhesiveness to photographic emulsion layers. Before or after receiving the subbing treatment, the surfaces of the support may be subjected to a corona discharge treatment, an ultraviolet irradiation treatment, a flame treatment, or so on.

In the photographic materials prepared in accordance with the present invention, photographic emulsion layers and other layers can be coated on a support or other layers using conventional coating methods. Examples of such coating methods include dip coating, roller coating, curtain coating, extrusion coating, and so on. The methods disclosed in U.S. Pat. Nos. 2,681,294, 2,761,791 and 3,526,528 can be used to advantage in coating such layers.

The present invention can be applied to a multilayer multicolor photographic material having layers of at least two different spectral sensitivities on the support. A multilayer color photographic material usually has at least one red-sensitive emulsion layer, at least one green-sensitive emulsion layer and at least one blue-sensitive emulsion layer. The laminating order of these layers can be arbitrarily selected. It is general, however, to incorporate a cyan forming coupler in a red-sensitive emulsion layer, a magenta forming coupler in a green-sensitive emulsion layer, and a yellow forming coupler in a blue-sensitive emulsion layer. However, different combinations may be used.

The exposure for obtaining a photographic image is carried out in a conventional manner. Any known light sources including natural light (sunlight), a tungsten lamp, a fluorescent lamp, a mercury lamp, a xenon arc lamp, a carbon arc lamp, a xenon flash lamp, a CRT spot and so on can be employed for exposure.

Suitable exposure times which can be used include not only exposure times commonly used in cameras ranging from about 1/1,000 to about 1 sec., but also exposure times shorter than 1/1,000 sec., for example, about $1/10^4$ to about $1/10^6$ sec. as with xenon flash lamps and cathode ray tubes. Exposure times longer than 1 second can also be used. The spectral distribution of the light employed for the exposure can be controlled using color filters, if desired. Laser beams can also be employed for exposure. Moreover, the emulsions of the present invention may also be exposed to light emitted from phosphors excited by electron beams, X-rays, $\gamma$-rays, $\alpha$-rays and the like.

In the photographic emulsion layers of photographic materials prepared in accordance with the present invention, color forming couplers, that is, compounds capable of forming colors by oxidative coupling with aromatic primary amine developers (e.g., phenylenediamine derivatives, aminophenol derivatives, etc.) in color development processing may be used in combination with polymer coupler latexes, or may be used independently of polymer coupler latexes by addition to a layer not containing a polymer coupler latex. Examples of magenta couplers which can be used include conventional 5-pyrazolone couplers, pyrazolobenzimidazole couplers, cyanoacetylcumarone couplers, open-chain acylacetonitrile couplers and so on. Examples of yellow couplers which can be used include acylacetamide couplers (e.g., benzoyl acetanilides, pivaloyl acetanilides, etc.), and so on. Examples of cyan couplers which can be used include naphthol couplers, phenol couplers, and so on. These couplers can provide desirable results when they have hydrophobic groups (ballast groups) in their molecules and are thereby rendered non-diffusible. These couplers may be 4-equivalent or 2-equivalent. Moreover, they may be colored couplers having a color correcting effect, or couplers capable of releasing development restrainers with the progress of development (DIR couplers). In addition to DIR couplers, colorless DIR coupling compounds which yield colorless products upon coupling and release development restrainers may be used.

Specific examples of magenta color forming couplers which can be used are disclosed in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Pat. No. 1,810,464, West German Patent Application (OLS) Nos. 2,408,665, 2,417,945, 2,418,959 and 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76 and 55122/78, and so on.

Specific examples of yellow color forming couplers which can be used are disclosed in U.S. Pat. Nos. 2,875,057, 3,265,506, 3,408,194, 3,551,155, 3,582,322, 3,725,072 and 3,891,445, West German Pat. No. 1,547,868, West German Patent Application (OLS) Nos. 2,219,917, 2,261,361 and 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77 and 115219/77, and so on.

Specific examples of cyan couplers which can be used are described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, West German Patent Application (OLS) Nos. 2,414,830 and 2,454,329, Japanese Patent Application (OPI) Nos. 59838/73, 26034/76, 5055/73, 146828/76, 69624/77 and 90932/77, and so on.

Specific examples of colored couplers which can be used in the present invention are described in, e.g., U.S. Pat. Nos. 3,476,560, 2,521,908 and 3,034,892, Japanese Patent Publication Nos. 2016/69, 22335/63, 11304/67 and 32461/69, Japanese Patent Application (OPI) Nos. 26034/76 and 42121/77, and West German Patent Application (OLS) No. 2,418,959.

Specific examples of DIR couplers which can be used in the present invention are described in, e.g., U.S. Pat. Nos. 3,227,554, 3,617,291, 3,701,783, 3,790,384 and 3,632,345, West German Patent Application (OLS) Nos. 2,414,006, 2,454,301 and 2,454,329, British Pat. No. 953,454, Japanese Patent Application (OPI) Nos. 69624/77 and 122335/74, and Japanese Patent Publication No. 16141/76.

Besides DIR couplers, compounds capable of releasing development restrainers with the progress of development may be incorporated in the light-sensitive materials. Specific examples thereof are described in, e.g., U.S. Pat. Nos. 3,297,445 and 3,379,529, West German Patent Application (OLS) No. 2,417,914, and Japanese Patent Application (OPI) Nos. 15271/77 and 9116/78.

In the photographic materials per the present invention, photographic emulsion layers and other hydrophilic colloidal layers may contain inorganic or organic hardeners. Specific examples thereof include chromium salts (e.g., chrome alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl)-hexahydro-s-triazine, 1,3-vinylsulfonyl-2-propanol, etc.), active halogen compounds (e.g., 2,4-dichloro-6-hydroxy-s-triazine, etc.), mucohalogenides (e.g., mucochloric acid, mucophenoxychloric acid, etc.), and so on. Such hardeners may be used individually or as a combination of two or more thereof.

In case that the hydrophilic colloidal layers of the photographic materials of the present invention contain dyes and ultraviolet absorbents, they may be mordanted by cationic polymers and the like. Specific examples of such polymers are described in, e.g., British Pat. No. 685,475, U.S. Pat. Nos. 2,675,316, 2,839,401, 2,882,156, 3,048,487, 3,184,309 and 3,445,231, West German Patent Application (OLS) No. 1,914,362, Japanese Patent Application (OPI) Nos. 47624/75 and 71332/75, and so on.

The photographic materials prepared in accordance with the present invention may contain a color fog preventing agent, such as a hydroquinone derivative, aminophenol derivative, gallic acid derivative, ascorbic acid derivative, and the like.

The hydrophilic colloidal layers of the photographic materials prepared in accordance with the present invention may contain ultraviolet absorbents. Specific examples thereof include benzotriazole compounds substituted with aryl groups, 4-thiazolidone compounds, benzophenone compounds, cinnamic acid esters, butadiene compounds, benzoxazole compounds, and, further, ultraviolet absorbing polymers. These ultraviolet absorbents may be fixed in the hydrophilic colloidal layers to which they are added.

More specifically, such ultraviolet absorbents are described in U.S. Pat. Nos. 3,533,794, 3,314,794 and 3,352,681, Japanese Patent Application (OPI) No. 2784/71, U.S. Pat. Nos. 3,705,805, 3,707,375, 4,045,229, 3,700,455 and 3,499,762, West German Patent Publication 1,547,863, and so on.

Hydrophilic colloidal layers of the photographic materials prepared in accordance with the present invention may contain water-soluble dyes for various purposes, e.g., as filter dyes, prevention of irradiation, and so on. Examples of such dyes include oxonol dyes, hemioxonol dyes, styryl dyes, merocyanine dyes, cyanine dyes and azo dyes. Among these dyes, oxonol dyes, hemioxonol dyes and merocyanine dyes are used to greater advantage.

Known discoloration inhibitors can be used in practice of the present invention and, further, color image stabilizing agents can also be used individually or as a combination of two or more thereof. Examples of known discoloration inhibitors include hydroquinone derivatives, gallic acid derivatives, p-alkoxyphenyls, p-oxyphenol derivatives and bisphenols.

Specific examples of hydroquinone derivatives which can be used for the above-described purpose are disclosed in U.S. Pat. Nos. 2,360,290, 2,418,613, 2,675,314, 2,701,197, 2,704,713, 2,728,659, 2,732,300, 2,735,765, 2,710,801 and 2,816,028, British Pat. No. 1,363,921, and so on.

Specific examples of gallic acid derivatives which can be used for the above-described purposes are described in U.S. Pat. Nos. 3,457,079 and 3,069,262, and so on; p-alkoxyphenols are disclosed in U.S. Pat. Nos. 2,735,765 and 3,698,909, Japanese Patent Publication Nos. 20977/74 and 6623/77, and so on; p-oxyphenol derivatives are disclosed in U.S. Pat. Nos. 3,432,300, 3,573,050, 3,574,627 and 3,764,337, Japanese Patent Application (OPI) Nos. 35633/77, 147434/77 and 152225/77, and so on; bisphenols are disclosed in U.S. Pat. No. 3,700,455.

EXAMPLE

On a cellulose triacetate film support were coated the layers described below in this order to prepare a multilayer color light-sensitive material.

(1) Antihalation layer containing black colloidal silver.

(2) Interlayer which is a gelatin layer containing an emulsified dispersion of 2,5-di-t-octylhydroquinone.

(3) Red-sensitive emulsion layer having low sensitivity which contains a silver iodobromide emulsion (containing 5 mol% of silver iodide and 1.79 g/m$^2$ of silver having a mean grain size of 0.5$\mu$), $6\times10^{-5}$ mol/mol silver of Sensitizing Dye I, $1.5\times10^{-5}$ mol/mol silver of Sensitizing Dye II, 0.06 mol/mol silver of Coupler A, 0.003 mol/mol silver of Coupler C, 0.003 mol/mol silver of Coupler D, and 0.3 cc/m$^2$ of tricresyl phosphate.

(4) Red-sensitive emulsion layer having high sensitivity which contains a silver iodobromide emulsion (containing 4 mol% of silver iodide and 1.4 g/m$^2$ of silver having a mean grain size of 0.7$\mu$), $3\times10^{-5}$ mol/mol silver of Sensitizing Dye I, $1.2\times10^{-5}$ mol/mol silver of Sensitizing Dye II, 0.0125 mol/mol silver of Coupler F, 0.0016 mol/mol silver of Coupler C and 0.2 cc/m$^2$ of tricresyl phosphate.

(5) Interlayer—which has the same composition as interlayer (2).

(6) Green-sensitive emulsion layer having low sensitivity which contains a silver iodobromide (containing 4 mol% of silver iodide and 1.0 g/m$^2$ of silver having a mean grain size of 0.5$\mu$), $3\times10^{-5}$ mol/mol silver of Sensitizing Dye III, $1\times10^{-5}$ mol/mol silver of Sensitizing Dye IV, 0.08 mol/mol silver of Coupler B, 0.008 mol/mol silver of Coupler M, 0.0015 mol/mol silver of Coupler D and 1.4 cc/m$^2$ of tricresyl phosphate.

(7) Green-sensitive emulsion layer having high sensitivity which contains a silver iodobromide emulsion (containing 5 mol% of silver iodide and 1.6 g/m$^2$ of silver having a mean grain size of 0.75$\mu$), $2.5\times10^{-5}$ mol/mol silver of Sensitizing Dye III, $0.8\times10^{-5}$ mol/mol silver of Sensitizing Dye IV, 0.02 mol/mol silver of Coupler B, 0.003 mol/mol silver of Coupler M, and 0.8 cc/m$^2$ of tricresyl phosphate.

(8) Yellow filter layer—which is a gelatin layer containing yellow colloidal silver and 2,5-di-t-octylhydroquinone in the form of an emulsified dispersion in an aqueous gelatin solution.

(9) Blue-sensitive emulsion layer having low sensitivity which contains a silver iodobromide emulsion (containing 6 mol% of silver iodide and 0.5 g/m$^2$ of silver having a mean grain size of 0.7$\mu$), 0.125 mol/mol silver of Coupler Y and 0.3 cc/m$^2$ of tricresyl phosphate.

(10) Blue-sensitive emulsion layer having high sensitivity which contains a silver iodobromide emulsion (containing 6 mol% of silver iodide and 0.6 g/m$^2$ of silver having a mean grain size of 0.8$\mu$), 0.04 mol/mol silver of Coupler Y and 0.1 cc/m$^2$ of tricresyl phosphate.

(11) Protective layer which is a gelatin layer containing polymethylmethacrylate particles (having a diameter of about 1.5$\mu$).

Each of the couplers described above was incorporated in their respective layers in the following manner: It was added to a mixture of tricresyl phosphate and ethyl acetate and there was added thereto sodium dodecylbenzenesulfonate as an emulsifier. The resulting mixture was heated to dissolve the coupler into the solvent and then the system was mixed with a warmed 10% gelatin solution and emulsified using a colloid mill. The thus obtained emulsion was added to the respective silver iodobromide emulsion.

To each of the layers described above, a conventional gelatin hardener and a surface active agent were also added.

The thus prepared light-sensitive material was named Sample 101.

Compounds employed for preparing Sample 101 are described below.

Sensitizing Dye I: Pyridinium salt of anhydro-5,5'-dichloro-3,3'-di(γ-sulfopropyl)-9-ethyl-thiacarbocyaninehydroxide Sensitizing Dye II: Triethylamine salt of anhydro-9-ethyl-3,3'-di(γ-sulfopropyl)dibenzo[4,5,4'5,']thiacarbocyanine hydroxide Sensitizing Dye III: Sodium salt of anhydro-9-ethyl-5,5'-dichloro-3,3'-di(γ-sulfopropyl)oxacarbocyanine Sensitizing Dye IV: Sodium salt of anhydro-5,6,5',6'-tetrachloro-1,1'-diethyl-3,3'-di{β-[β-(γsulfopropoxy)ethoxy]ethyl}imidazolocarbocyanine hydroxide Coupler A

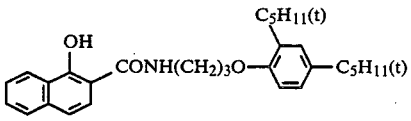

Coupler B

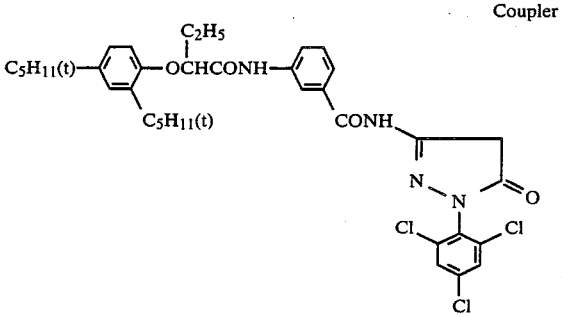

Coupler C

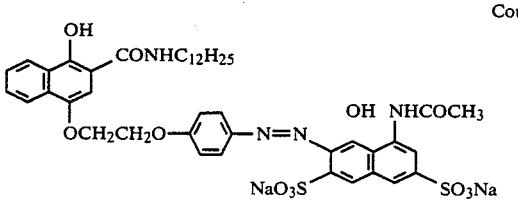

Coupler D

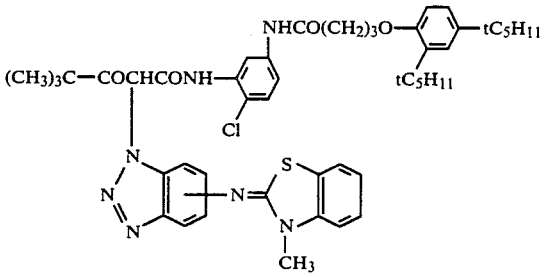

-continued

Coupler E

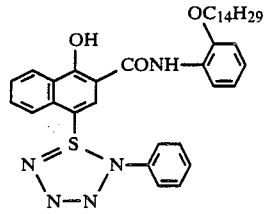

Coupler F

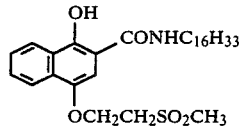

Coupler M

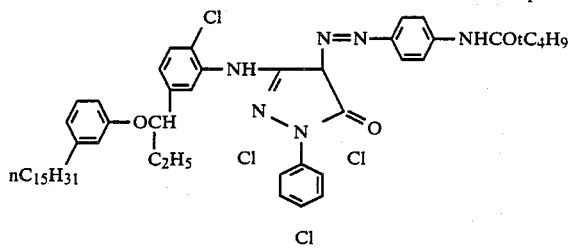

Coupler Y

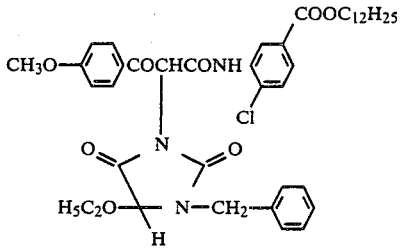

Samples 102 to 109 were prepared in the same manner as Sample 101 except that Coupler M and DIR coupler D contained in layer (6) and layer (7) were changed in kind and addition amount as to be set forth in Table 3.

In Samples 103 to 109 in which polymer couplers were used, the amount of tricresyl phosphate added was reduced to 1/10 the amount in Sample 101.

Each of the thus obtained samples were exposed to white light through a pattern for MTF measurement and subjected to the following development processing. The processing temperature employed was 38° C.

Processings (1) Color development: 3 min and 15 sec
(2) Bleach: 6 min and 30 sec
(3) Washing: 3 min and 15 sec
(4) Fix: 6 min and 30 sec
(5) Washing: 3 min and 15 sec
(6) Stabilization: 3 min and 15 sec Compositions of processing solutions used in the above-described processes are described below, respectively.

Color Developing Solution

Sodium Nitrilotriacetate: 1.0 g
Sodium sulfite: 4.0 g
Sodium Carbonate: 30.0 g
Potassium Bromide: 1.4 g
Hydroxylamine Sulfate: 2.4 g 4-(N-ethyl-N-β-hydroxyethylamino)-2-methylaniline Sulfate: 4.5 g
Water to make: 1 liter Bleaching Solution Ammonium Bromide: 160.0 g
Ammonia Water (28%): 25.0 ml
(Ethylenediaminetetraacetate) Iron (III) Complex Salt: 130 g
Glacial Acetic Acid: 14 ml
Water to make: 1 liter Fixing Solution Sodium Tetrapolyphosphate: 2.0 g
Sodium Sulfite: 4.0 g
Ammonium Thiosulfate (70%): 175.0 ml
Sodium Hydrogensulfite: 4.6 g
Water to make: 1 liter Stabilizing Solution Formalin: 8.0 ml
Water to make: 1 liter Each of the processed samples was subjected to MTF measurement of the magenta color image. MTF values at a spatial frequency of 5 cycles/mm, at a spatial frequency of 20 cycles/mm and at a spatial frequency of 35 cycles/mm, respectively, are set forth in Table 3.

TABLE 3

| Sample | Magenta Coupler Kind | Magenta Coupler Amount Added | DIR Coupler Kind | DIR Coupler Amount Added | MTF Values Spatial Frequency (cycles/mm) 5 | 20 | 35 |
|---|---|---|---|---|---|---|---|
| 101 (Comparison) | M | 1 | D | 1 | 1.03 | 0.48 | 0.24 |
| 102 (Comparison) | M | 1 | D-5 | 1.7 | 1.26 | 0.54 | 0.27 |
| 103 (Comparison) | XIV | 0.5 | D | 1 | 1.02 | 0.60 | 0.34 |
| 104 (This Invention) | XIV | 0.5 | D-5 | 1.7 | 1.28 | 0.68 | 0.38 |
| 105 (This Invention) | XIV | 0.5 | D-4 | 1.2 | 1.26 | 0.63 | 0.37 |
| 106 (This Invention) | XV | 0.8 | D-5 | 1 | 1.29 | 0.70 | 0.40 |
| 107 (This Invention) | XV | 0.8 | D-6 | 8 | 1.23 | 0.63 | 0.36 |
| 108 (This Invention) | XV | 0.8 | D-30 | 5 | 1.20 | 0.59 | 0.36 |
| 109 (Comparison) | XV | 0.8 | E | 1 | 1.08 | 0.64 | 0.38 |

Sample 101 was processed into a film of 35 mm size and of 110 size. On the other hand, each of samples 102 to 107 was processed only in 110 size. Images for MTF evaluation use were taken on these films by cameras controlled so as to provide pictures of the same size when printed on photographic paper. Each of these samples was subjected to the same processing as described above. All of the thus obtained images were enlarged into cabinet size at the time of printing. Evaluation of sharpness of the printed images was carried out using the Thurstone method (by 22 subjects), and the values obtained by psychological evaluation are shown in Table 4. As for the MTF values of used films set forth in Table 4, the MTF value at 20 cycles/mm in the case of subject sample A, and MTF values at 35 cycles/mm in the cases of subject samples B to I in which the enlargement magnification was 1.7 were taken from Table 1.

TABLE 4

| Subject Sample | Film Used | Film Size | Magnification Ratio | MTF Values 5 cycles/mm | MTF Values 35 cycles/mm | Thurstone Value |
|---|---|---|---|---|---|---|
| A | Sample 101 | 35 mm | 1 | 1.03 | 0.48 (at 20 c/mm) | 0.00 |
| B | 101 | 110 | 1.7 | 1.03 | 0.24 | 3.50 |
| C | 102 | 110 | 1.7 | 1.26 | 0.27 | 1.42 |
| D | 103 | 110 | 1.7 | 1.02 | 0.34 | 2.01 |
| E | 104 | 110 | 1.7 | 1.28 | 0.38 | 0.12 |
| F | 105 | 110 | 1.7 | 1.26 | 0.37 | 0.16 |
| G | 106 | 110 | 1.7 | 1.29 | 0.40 | 0.19 |
| H | 107 | 110 | 1.7 | 1.23 | 0.36 | 0.30 |
| I | 108 | 110 | 1.7 | 1.20 | 0.36 | 0.35 |
| J | 109 | 110 | 1.7 | 1.08 | 0.38 | 1.78 |

(The larger the Thurstone value, the lower the psychological resolution.)

It will be apparent from Table 4 that when the magnification was increased 1.7 times, resolution was influenced by the MTF values in the higher spatial frequency region (theoretically, the MTF value at the spatial frequency increased in proportion to the ratio of magnification becomes a subject of discussion. That is, when a film is processed changing 35 mm size to 110 size, the magnification of the latter becomes 1.7 times that of the former and, therefore, when attention is given to the spatial frequency of 20 cycles/mm in Sample A, the MTF value at 34 cycles/mm becomes a subject of discussion in the Sample B. In this example, values at 35 cycles/mm were taken) and, therefore, the MTF value of Sample B was lower than that of Sample A at the corresponding spatial frequency and, consequently, the Thurstone value of Sample B was bad.

In Sample C, the MTF value at 35 cycles/mm was 0.27, which was almost equal to that of Sample B. However, the MTF value at 5 cycles/mm was 1.26, considerably higher than that of Sample B. Therefore, a good Thurstone value was obtained, and resolution was also improved to an appreciable extent. However, such an improvement is still insufficient.

In Sample D, the MTF value at 35 cycles/mm was increased to 0.34, and, therefore, the Thurstone value was improved.

In Sample E, the MTF value at 35 cycles/mm was 0.38, almost equal to that of Sample D. However, the MTF value at 5 cycles/mm was greatly increased to 1.28. Therefore, the Thurstone value was markedly improved and reached the level of Sample A. This result suggests that if MTF values at high frequencies are first increased to a certain extent and, further, those at low frequencies are also increased, effects equivalent to those attained in the case where MTF values at high frequencies are increased to a great extent can be obtained.

In Sample J, in which an ordinary DIR coupler was used in place of a diffusible DIR coupler, the extent of the increase in the MTF value at 5 cycles/mm was insufficient and, therefore, the Thurstone value was not appreciably improved.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material which contains both a coupler capable of releasing a diffusible development restrainer upon coupling and a polymer coupler latex, said silver halide color photographic material having improved visual sharpness in a high spatial frequency region and in a low spatial frequency region due to the combined use of said coupler capable of releasing a diffusible development restrainer upon coupling and said polymer coupler latex.

2. The silver halide color photographic material of claim 1, wherein said coupler capable of releasing a diffusible development restrainer upon coupling and said polymer coupler latex are contained in the same layer of the silver halide color photographic material.

3. The silver halide color photographic material of claim 1, wherein said coupler capable of releasing a diffusible development restrainer has a diffusibility of about 0.4 or more.

4. The silver halide color photographic material of claim 1, wherein said coupler capable of releasing a diffusible development restrainer has a diffusibility of not higher than about 1.0.

5. The silver halid color photographic material of claim 1, wherein said low spectral frequency region is 2 to 5 cycle/mm and said high spectral frequency region is above 20 cycle/mm.

6. The silver halide color photographic material of claim 5, wherein MTF values in the low spectral frequency region are raised to over 1.15.

7. The silver halide color photographic material of claim 6, wherein said MTF values are raised to over 1.5.

8. The silver halide color photographic material of claim 7, wherein said coupler capable of releasing a diffusible development restrainer has a diffusibility of about 0.4 to about 1.0.

9. The silver halide color photographic material of claim 8, wherein said polymer coupler latex is added in the range of 0.005 to 0.5 mol per mol of silver based on the corresponding monomeric coupler and the diffusible development restrainer is added in an amount of 0.0001 to 0.5 mol per mol of silver.

* * * * *